US006908173B2

(12) United States Patent
Otsuki et al.

(10) Patent No.: US 6,908,173 B2
(45) **Date of Patent: *Jun. 21, 2005**

(54) POSITIONAL DEVIATION CORRECTION USING REFERENCE AND RELATIVE CORRECTION VALUES IN BI-DIRECTIONAL PRINTING

(75) Inventors: Koichi Otsuki, Nagano-ken (JP); Shuji Yonekubo, Nagano-ken (JP); Kazushige Tayuki, Nagano-ken (JP); Toyohiko Mitsuzawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/687,656

(22) Filed: Oct. 20, 2003

(65) Prior Publication Data

US 2004/0080555 A1 Apr. 29, 2004

Related U.S. Application Data

(63) Continuation of application No. 09/497,168, filed on Feb. 3, 2000, now Pat. No. 6,692,096.

(30) Foreign Application Priority Data

Feb. 10, 1999 (JP) ..... 11-032163
Aug. 18, 1999 (JP) ..... 11-231269

(51) Int. Cl.[7] ..... B41J 29/393

(52) U.S. Cl. ..... 347/19; 347/14; 347/15; 347/43

(58) Field of Search ..... 347/19, 43, 14, 347/15; 400/76, 124.01

(56) References Cited

U.S. PATENT DOCUMENTS

| | | | | |
|---|---|---|---|---|
| 4,675,696 | A | 6/1987 | Suzuki | 347/19 |
| 6,039,427 | A | 3/2000 | Kanome | 347/19 |
| 6,082,911 | A | 7/2000 | Murakami | 400/74 |
| 6,196,736 | B1 | 3/2001 | Otsuki et al. | 400/124.01 |
| 6,267,519 | B1 | 7/2001 | Otsuki et al. | 400/283 |
| 6,334,720 | B1 | 1/2002 | Kato et al. | 400/74 |

FOREIGN PATENT DOCUMENTS

| | | |
|---|---|---|
| EP | 0 813 973 | 12/1997 |
| EP | 0 849 702 | 6/1998 |
| EP | 0 858 049 | 8/1998 |
| EP | 0 895 869 | 2/1999 |
| JP | 62-263063 | 11/1987 |
| JP | 5-69625 | 3/1993 |
| JP | 7-81190 | 3/1995 |
| JP | 9-193407 | 7/1997 |
| JP | 10-329380 | 12/1998 |
| JP | 2001-018375 | 1/2001 |

OTHER PUBLICATIONS

Patent Abstracts of Japan, JP 2000–127360, May 9, 2000.

*Primary Examiner*—Hai Pham
*Assistant Examiner*—Lam Nguyen
(74) *Attorney, Agent, or Firm*—Oblon, Spivak, McClelland, Maier & Neustadt, P.C.

(57) ABSTRACT

In the bi-directional printing, a reference correction value is set for correcting printing positional deviation arising between forward and reverse main scanning passes with respect to specific reference dots. An adjustment value is determined, using at least the reference correction value, to reduce printing positional deviation arising between forward and reverse main scanning passes. The printing positional deviation between forward and reverse main scanning passes is adjusted using the adjustment value. In a first adjustment mode, the adjustment value is determined by correcting the reference correction value with a relative correction value prepared beforehand for correcting the reference correction value.

30 Claims, 23 Drawing Sheets

POSITIONAL DEVIATION DURING BI-DIRECTIONAL PRINTING FOR DOTS OF DIFFERENT INKS

TEST PATTERN FOR DETERMINING RELATIVE CORRECTION VALUE

| HEAD ID | Δ (μm) |
|---|---|
| 1 | −35.0 |
| 2 | −17.5 |
| 3 | 0 |
| 4 | +17.5 |

TEST PATTERN FOR DETERMINING
REFERENCE CORRECTION VALUE

BEFORE ADJUSTMENT

ADJUSTED BASED ON REFERENCE CORRECTION VALUE (K ONLY)

ADJUSTED BASED ON REFERENCE CORRECTION VALUE (K + C)

ADJUSTED BASED ON REFERENCE + RELATIVE CORRECTION VALUES (K + C)

K DOTS AND C DOTS ARE THE TARGET OF ADJUSTMENT (RELATIVE CORRECTION VALUE $\Delta = -\delta c$)

WAVEFORMS OF BASE DRIVE SIGNAL IN THIRD EMBODIMENT

THIRD EMBODIMENT

TEST PATTERN FOR DETERMINING RELATIVE CORRECTION VALUES

RELATIVE CORRECTION VALUE FOR SMALL DOTS: $\Delta S = (\delta S - \delta L)$
RELATIVE CORRECTION VALUE FOR MEDIUM DOTS: $\Delta M = (\delta M - \delta L)$

BEFORE ADJUSTMENT (LARGE DOTS)

ADJUSTED BASED ON REFERENCE CORRECTION VALUE (LARGE DOTS ONLY)

ADJUSTED BASED ON REFERENCE CORRECTION VALUE (LARGE DOTS + SMALL DOTS)

ADJUSTED BASED ON REFERENCE + RELATIVE CORRECTION VALUES (LARGE DOTS + SMALL DOTS)

SMALL DOTS ARE THE TARGET OF ADJUSTMENT

POSITIONAL DEVIATION CORRECTION USING REFERENCE AND RELATIVE CORRECTION VALUES IN BI-DIRECTIONAL PRINTING

CROSS-REFERENCE TO RELATED APPLICATIONS

This is a continuation application of parent U.S. application Ser. No. 09/497,168, filed Feb. 3, 2000 now U.S. Pat. No. 6,692,096. This application is based upon and claims the benefit of priority from Japanese Patent Application No. 11-032163, filed Feb. 10, 1999 and Japanese Patent Application No. 11-231269, filed Aug. 18, 1999, and the entire contents of the parent application and both Japanese applications are hereby incorporated herein by reference.

BACKGROUND OF THE INVENTION

1. Field of the Invention

This invention relates to a technology for printing images on a print medium using a bi-directional reciprocating movement in a main scanning direction. The invention particularly relates to a technology for correcting printing positional deviation between forward and reverse passes.

2. Description of the Related Art

In recent years color printers that emit colored inks from a print head are coming into widespread use as computer output devices. In recent years, such color printers have been devised as multilevel printers able to print each pixel using a plurality of dots having different sizes. Such printers use relatively small ink droplets to form relatively small dots on a pixel position, and relatively large ink droplets to form relatively large dots on a pixel position. These printers can also print bi-directionally to increase the printing speed.

A problem that readily arises in bi-directional printing is that of deviation in printing position between forward and reverse printing passes in the main scanning direction caused by backlash in the main scanning drive mechanism and warping of the platen that supports the print media. JP-A-5-69625 is an example of a technology disclosed by the present applicants for solving this problem of positional deviation. This comprises of registering beforehand the printing deviation amount in the main scanning direction and using this printing deviation amount as a basis for correcting the positions at which dots are printed during forward and reverse passes.

However, in the case of bi-directional printing using multilevel printers, little consideration has been given to positional deviation arising between forward and reverse printing passes. Other problems include that while deviation may be corrected with respect to a particular one of the multiple colored inks, there is no correction of deviation in other ink colors. As a result, the deviation correction provides little improvement in the quality of the color image. The effect that positional deviation has on image quality is particularly large in halftone regions.

SUMMARY OF THE INVENTION

An object of the present invention is to improve image quality by alleviating printing positional deviation arising between forward and reverse passes in the main scanning direction during bi-directional printing.

In order to attain at least part of the above and other objects of the present invention, a reference correction value is set for correcting printing positional deviation arising between forward and reverse main scanning passes with respect to specific reference dots. An adjustment value is determined, using at least the reference correction value, to reduce printing positional deviation arising between forward and reverse main scanning passes. The printing positional deviation between forward and reverse main scanning passes is adjusted using the adjustment value. In a first adjustment mode, the adjustment value is determined by correcting the reference correction value with a relative correction value prepared beforehand for correcting the reference correction value.

This arrangement improves image quality under various printing conditions by alleviating printing positional deviation arising between forward and reverse passes in the main scanning direction.

When the print head has a plurality of nozzle rows, the reference correction value may be a correction value for correcting printing positional deviation arising between forward and reverse main scanning passes with respect to a reference row of nozzles, and the relative correction value may be a correction value for correcting relative printing positional deviation of another row against the reference row. This arrangement reduces printing positional deviation relating to another row of nozzles other than the reference row of nozzles.

The reference row may a row of nozzles for emitting black ink and the another row may include a row of nozzles for emitting chromatic color ink.

The relative correction value may be applied in common to the rows of nozzles other than the reference row.

Alternatively, the relative correction values may be applied independently to respective rows of nozzles other than the reference row. This arrangement effectively reduces printing positional deviation of each row of nozzles.

The relative correction values may be applied independently to respective groups of nozzles for emitting respective inks. The amount of relative printing positional deviation depends on the properties of the ink, so printing positional deviation can be more effectively reduced by applying relative correction values on an individual, ink-by-ink basis.

When the print head is capable of printing N types (where N is an integer of 2 or more) of dots which are different at least in size, the reference dots may be one type of dots selected from among the N types of dots. In this case, the adjustment value may be applied in common to the N types of dots in the first adjustment mode. In this way, the printing positional deviation can be alleviated with respect to N types of dots, improving image quality.

The reference dots are preferably largest of the N types of dots. Thus, when a test pattern for setting the reference correction value is printed using the largest dots, it is easy to detect positional deviation on the pattern, thereby facilitating the setting of the reference correction values.

The relative correction value may substantially represent a difference between an amount of positional deviation relating to target dots and an amount of positional deviation relating to the reference dots, where the target dots include at least one type of dots among the N types of dots, and where the at least one type of dots include dots smaller than the reference dots. This arrangement reduces positional deviation of the target dots that affect image quality.

The target dots may be smallest of the N types of dots. In many cases, image degradation tends to be more noticeable in places where the image density is relatively low, and the smallest size dots are used extensively when the image density is relatively low. As such, image quality in low-density regions can be improved by selecting the smallest dots to use as the target dots for reducing positional deviation.

The target dots may include plural types of dots of different sizes, and an average of the positional deviation amounts of the plural types of dots may be used as the positional deviation amount for the target dots. This arrangement reduces printing positional deviation with respect to plural types of dots that have a relatively large influence on image quality.

The reference dots may be formed of black ink and the target dots may be formed of chromatic color ink. Using black dots to print a test pattern for determining the reference correction value makes it easier to perceive deviations on the pattern, thereby facilitating the setting of the reference correction value. In the case of color images, dots printed in chromatic color inks affect the image quality to a major degree, so the quality of color images can be improved by reducing positional deviation of chromatic color ink dots.

The adjustment value may be determined in a second adjustment mode in which the reference correction value is used as the adjustment value. This adjustment value is used to adjust positional deviation of at least the reference dots. When positional deviation of reference dots is particularly noticeable, this reduces such deviation.

The printing positional deviation may be adjusted in accordance with the first adjustment mode during color printing, and in accordance with the second adjustment mode during monochrome printing. When printing in color, the overall positional deviation of the rows of nozzles is reduced, while during monochrome printing the positional deviation of just the reference row of nozzles (black-ink nozzles, in this case) is reduced. Thus, printing positional deviation can be effectively reduced when printing in color and when printing in monochrome.

The reference correction value may be determined according to correction information indicative of a preferred correction state that is selected from among test patterns of positional deviation printed using the reference dots. This facilitates the setting of the reference correction value.

When the bi-directional printing apparatus is capable of performing main scanning at a plurality of main scanning velocities, the relative correction values may be applied independently to the plurality of main scanning velocities. Since the relative degree of printing positional deviation depends on the main scanning velocity, such deviation can be effectively reduced by applying individual relative correction values for each main scanning velocity.

When the bi-directional printing apparatus is capable of emitting ink in a plurality of dot emission modes of mutually different ink emission velocities, the relative correction values may be applied independently to the plurality of dot emission modes. Since the relative degree of printing positional deviation depends on the ink emission velocity, such deviation can be effectively reduced by applying individual relative correction values for each ink emission velocity.

The second memory is preferably a non-volatile memory provided within the bi-directional printing apparatus.

Furthermore, the second memory is preferably attached to the print head so that the print head with the second memory is detachably attached to the bi-directional printing apparatus. Thus, when a print head is replaced, the relative correction value specifically for the new print head is used to reduce the printing positional deviation.

Specific aspects of the invention can be applied to various types of printing apparatus, printing methods, computer programs for implementing the printing apparatus or printing methods, computer program products storing the computer programs, and data signals embodied in a carrier wave including the computer programs.

These and other objects, features, aspects, and advantages of the present invention will become more apparent from the following detailed description of the preferred embodiments with the accompanying drawings.

DESCRIPTION OF THE PREFERRED EMBODIMENT

Various embodiments of the present invention will be explained in the following order.

Figure 1:
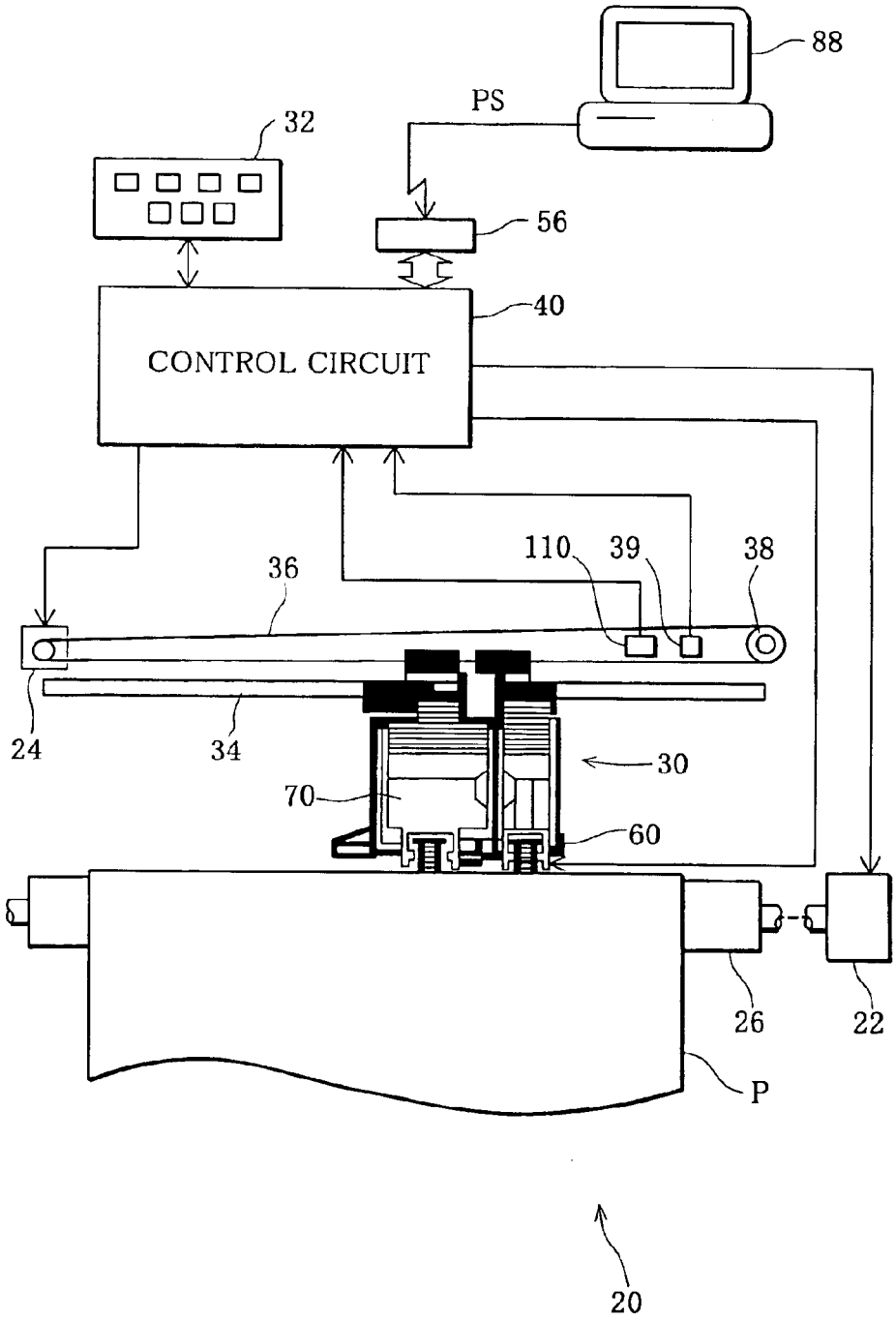
FIG. 1 shows the general configuration of a printing system equipped with a printer 20 of the first embodiment.

A. Apparatus configuration:

B. Generation of printing positional deviation between nozzle rows:

C. First embodiment (first example of correcting positional deviation between nozzle rows):

D. Second embodiment (second example of correcting positional deviation between nozzle rows):

E. Third embodiment (correction of positional deviation between dots of different sizes):

F. Modifications:

A. Apparatus Configuration:

FIG. 1 shows the general configuration of a printing system provided with an inkjet printer 20, constituting a first embodiment of the invention. The inkjet printer 20 includes a sub-scanning feed mechanism that uses a paper feed motor 22 to transport the printing paper P, a main scanning mechanism that uses a carriage motor 24 to effect reciprocating movement of a carriage 30 in the axial (main scanning) direction of a platen 26, a head drive mechanism that drives a print head unit 60 (also referred to as a print head assembly) mounted on the carriage 30 and controls ink emission and dot formation, and a control circuit 40 that controls signal traffic between a control panel 32 and the feed motor 22, the carriage motor 24 and the print-head unit 60. The control circuit 40 is connected to a computer 88 via a connector 56.

The sub-scanning feed mechanism that transports the paper P includes a gear-train (not shown) that transmits the rotation of the feed motor 22 to paper transport rollers (not shown). The main scanning feed mechanism that reciprocates the carriage 30 includes a slide-shaft 34 that slidably supports the carriage 30 and is disposed parallel to the shaft of the platen 26, a pulley 38 connected to the carriage motor 24 by an endless drive belt 36, and a position sensor 39 for detecting the starting position of the carriage 30.

Figure 2:
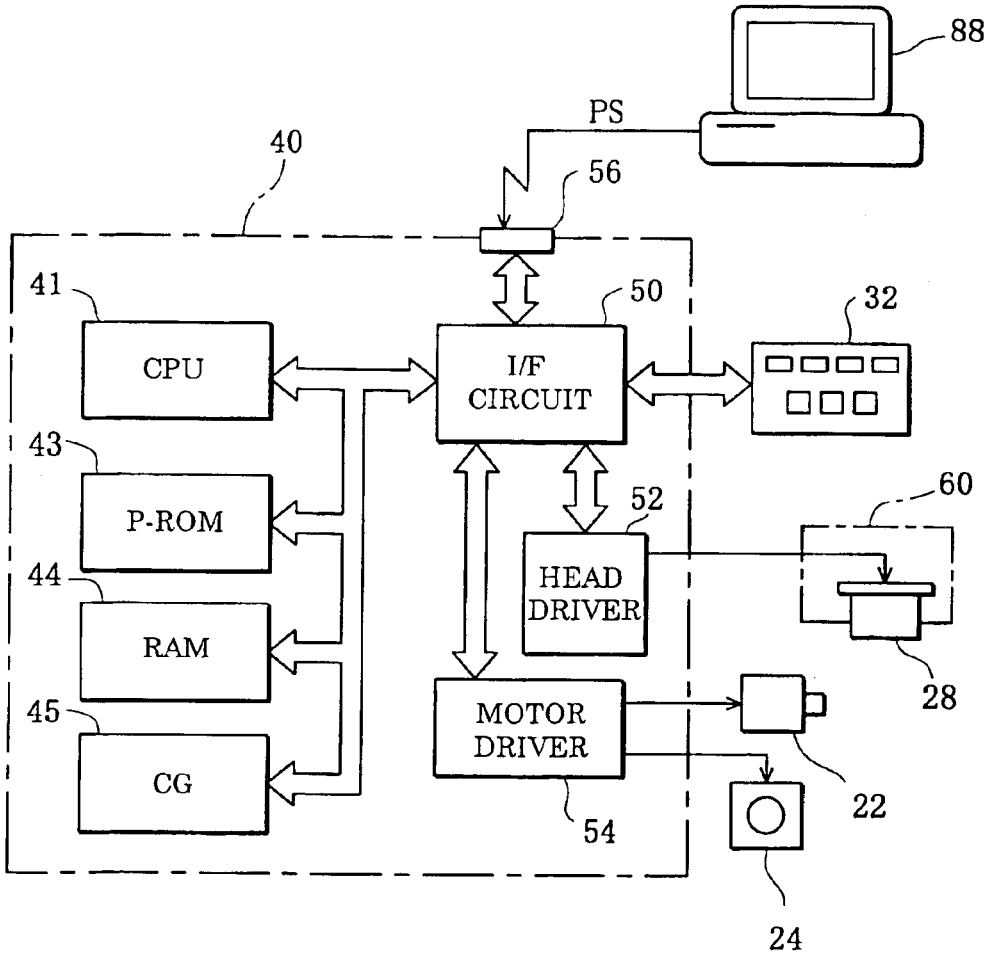
FIG. 2 is a block diagram showing the configuration of a control circuit 40 of the printer 20.

FIG. 2 is a block diagram showing the configuration of the inkjet printer 20 centering on the control circuit 40. The control circuit 40 is configured as an arithmetical logic processing circuit that includes a CPU 41, a programmable ROM (PROM) 43, RAM 44, and a character generator (CG) 45 in which is stored a character matrix. The control circuit 40 is also provided with an interface (I/F) circuit 50 for interfacing with external motors and the like, a head drive circuit 52 that is connected to the I/F circuit 50 and drives the print head unit 60 to emit ink, and a motor drive circuit 54 that drives the feed motor 22 and the carriage motor 24. The I/F circuit 50 incorporates a parallel interface circuit and, via the connector 56, can receive print signals PS from the computer 88.

Figure 3:
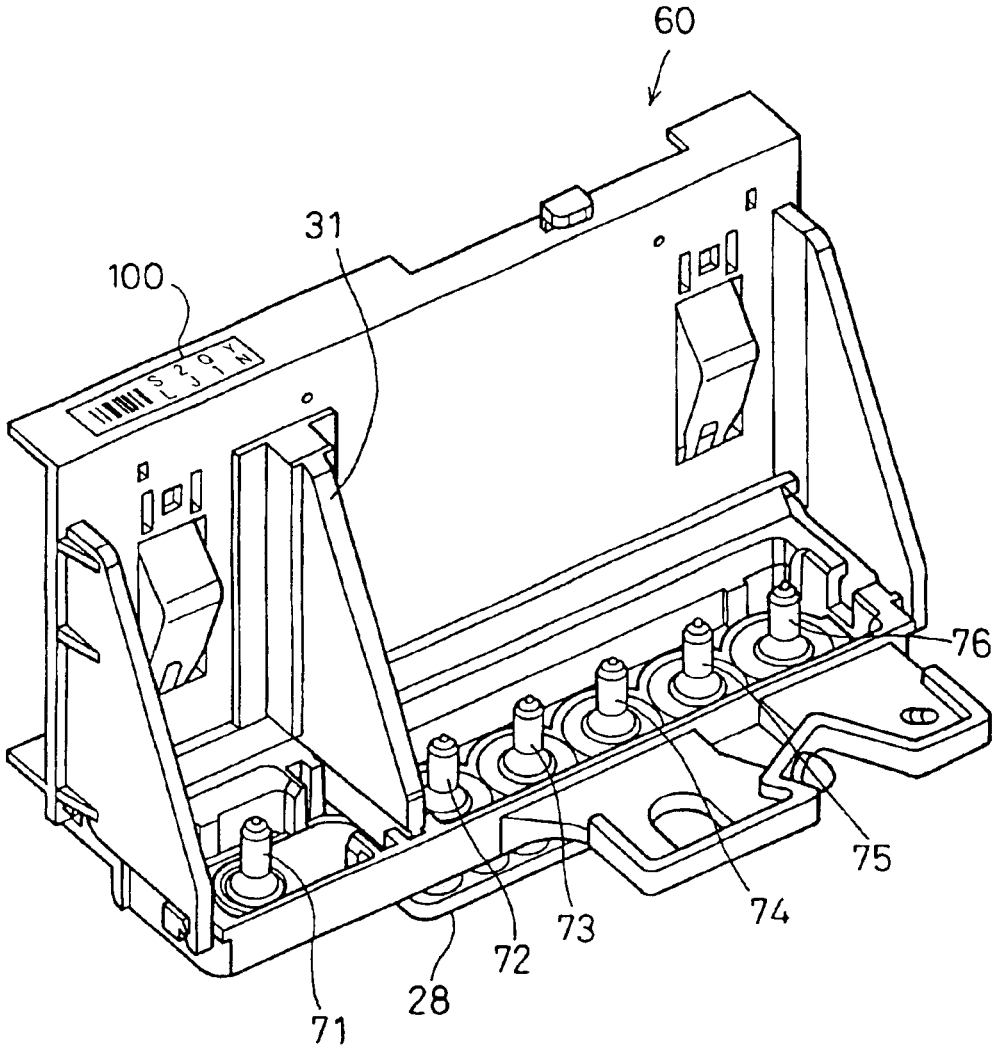
FIG. 3 is a perspective view of a print head unit 60.

FIG. 3 is a diagram illustrating a specific configuration of the print head unit 60. As can be seen, the print head unit 60 is L-shaped, and can hold black and colored ink cartridges (not shown). The print head unit 60 is provided with a divider plate 31 to allow both cartridges to be installed.

An ID seal 100 is provided on the top edge of the print head unit 60. The ID seal 100 displays head identification information pertaining to the print head unit 60. Details of the head identification information provided by the ID seal 100 are described later.

The print head unit 60 constituted by the print head 28 and the ink cartridge holders is so called since it is removably installed in the inkjet printer 20 as a single component. That is, when a print head 28 is to be replaced, it is the print head unit 60 itself that is replaced.

The bottom part of the print head unit 60 is provided with ink channels 71 to 76 via which ink from ink tanks is supplied to the print head 28. When black and colored ink cartridges are pressed down onto the print head unit 60, the ink channels 71 to 76 are inserted into the respective ink chambers of the cartridges.

Figure 4:
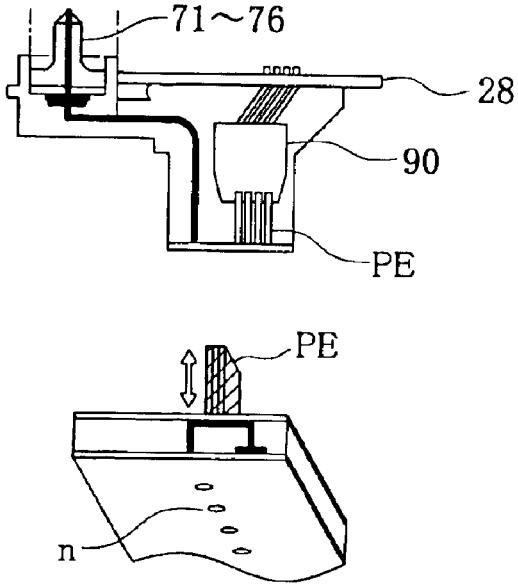
FIG. 4 illustrates the ink emission structure of the print head.

FIG. 4 illustrates the mechanism used to emit ink. When ink cartridges are installed on the print head unit 60, ink from the cartridges is drawn out via the ink channels 71 to 76 and channeled to the print head 28 provided on the underside of the print head unit 60.

For each color, the print head 28 has a plurality of nozzles n arranged in a line, and an actuator circuit 90 for activating a piezoelectric element PE with which each nozzle n is provided. The actuator circuit 90 is a part of the head drive circuit 52 (FIG. 2), and controls the switching on and off drive signals supplied from a drive signal generator (not shown). Specifically, for each nozzle, in accordance with a print signal PS supplied from the computer 88 the actuator circuit 90 is latched on (ink is emitted) or off (ink is not emitted), and applies a drive signal to piezoelectric elements PE only in respect of nozzles that are switched on.

Figure 5A:
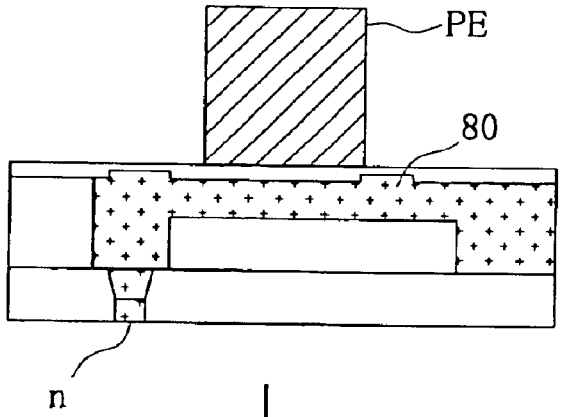
FIGS. 5(A) and 5(B) illustrate the arrangement whereby ink particles Ip are emitted by the expansion of a piezoelectric element PE.
Figure 5B:
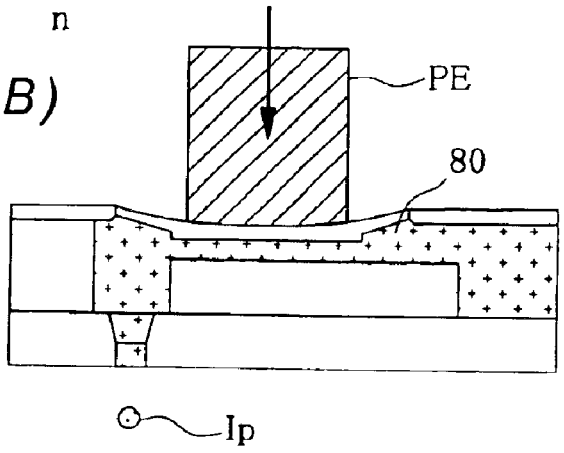

FIGS. 5(A) and 5(B) illustrate the principle based on which a nozzle n is driven by the piezoelectric element PE. The piezoelectric element PE is provided at a position where it is in contact with an ink passage 80 via which ink flows to the nozzle n. In this embodiment, when a voltage of prescribed duration is applied across the electrodes of the piezoelectric element PE, the piezoelectric element PE rapidly expands, deforming a wall of the ink channel 80, as shown in FIG. 5(B). This reduces the volume of the ink channel 80 by an amount corresponding to the expansion of the piezoelectric element PE, thereby expelling a corresponding amount of ink in the form of a particle Ip that is emitted at high speed from the nozzle n. Printing is effected by these ink particles Ip soaking into the paper P on the platen 26.

Figure 6:
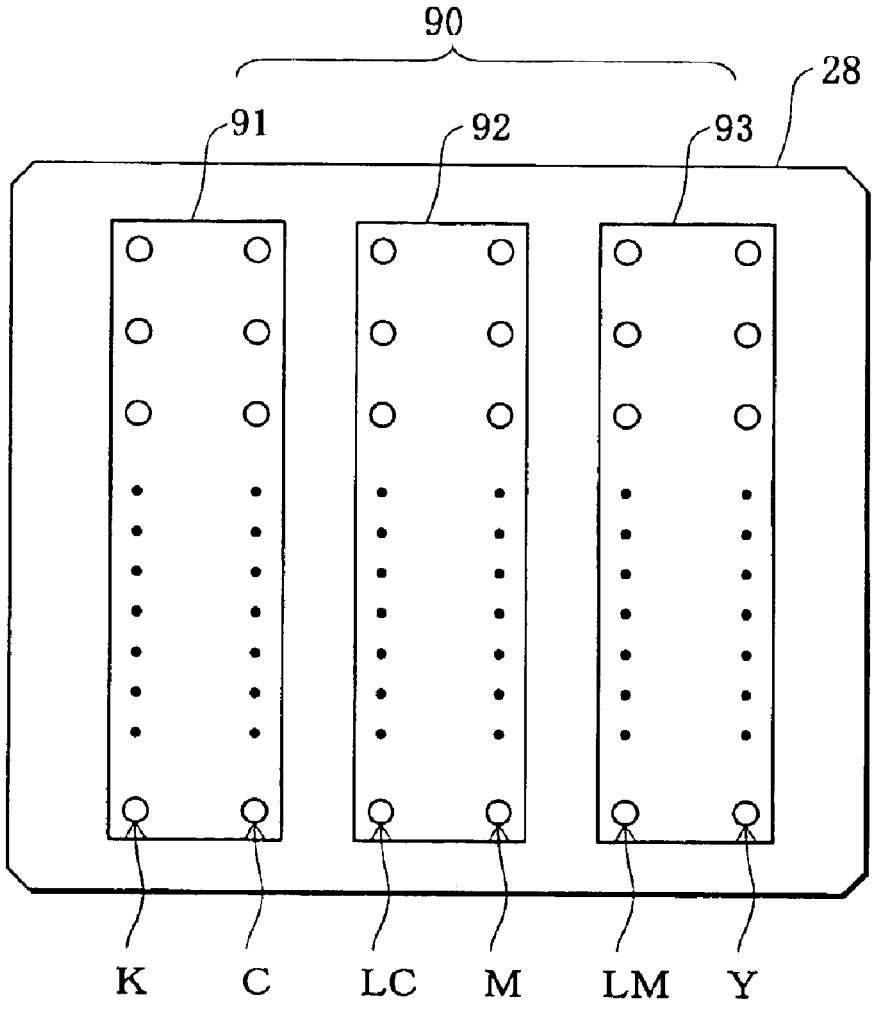
FIG. 6 is a diagram illustrating the positional relationship between the rows of nozzles in the print head 28 and the actuator chips.

FIG. 6 is a diagram illustrating the positional relationship between the rows of nozzles in the print head 28 and the actuator chips. The inkjet printer 20 prints using inks of the six colors black (K), dark cyan (C), light cyan (LC), dark magenta (M), light magenta (LM) and yellow (Y), and has a row of nozzles for each color. Dark cyan and light cyan are cyan inks of different density having more or less the same hue. This is also the case with respect to dark magenta and light magenta.

The actuator circuit 90 is provided with a first actuator chip 91 that drives the row of black ink nozzles K and the row of dark cyan ink nozzles C, a second actuator chip 92 that drives the row of row of light cyan ink nozzles LC and the row of dark magenta ink nozzles M, and a third actuator chip 93 that drives the row of light magenta ink nozzles LM and the row of yellow ink nozzles Y.

Figure 7:
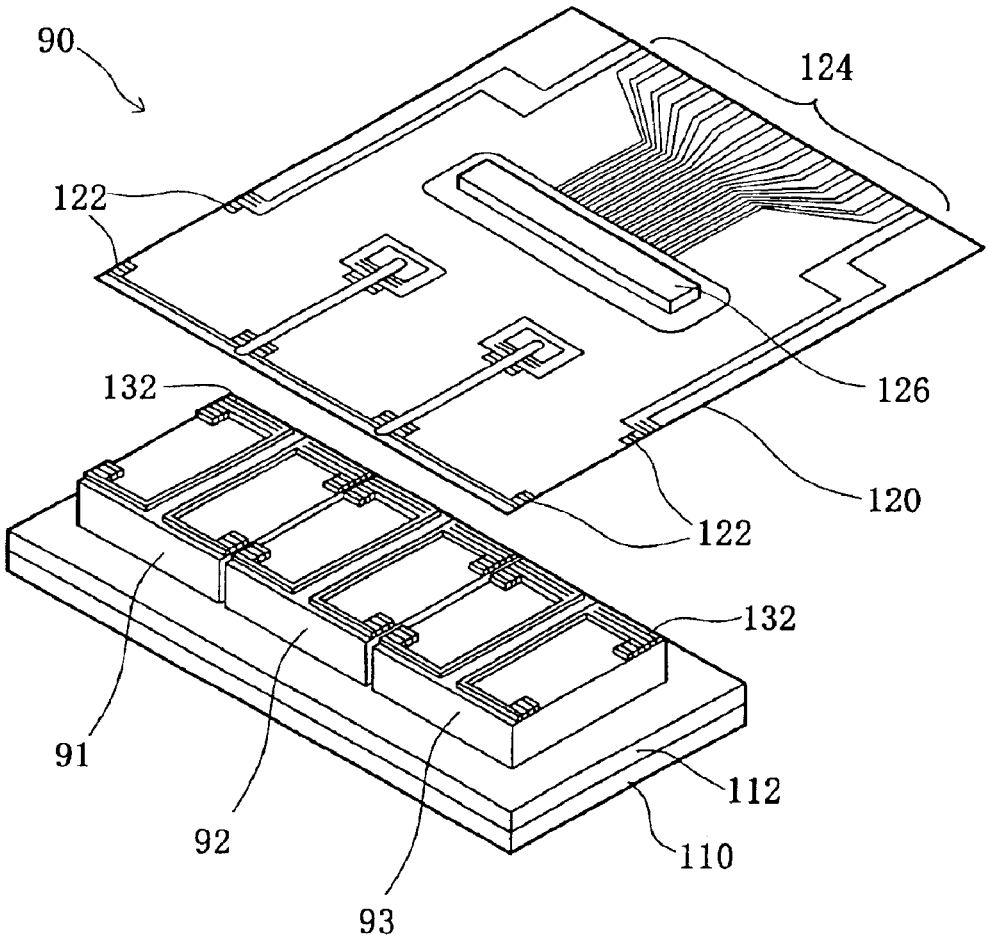
FIG. 7 is an exploded perspective view of the actuator circuit 90.

FIG. 7 is an exploded perspective view of the actuator circuit 90. Using adhesive, the three actuator chips 91 to 93 are bonded to the top of a laminated assembly comprised of a nozzle plate 110 and a reservoir plate 112. A contact terminal plate 120 is affixed over the actuator chips 91 to 93. Formed on one edge of the contact terminal plate 120 are terminals 124 for forming electrical connections with an external circuit (specifically the I/F circuit 50 of FIG. 2). Provided on the underside of the contact terminal plate 120 are internal contact terminals 122 for connecting the actuator chips 91 to 93. A driver IC 126 is provided on the contact terminal plate 120. The driver IC 126 has circuitry for latching print signals supplied from the computer 88, and an analogue switch for switching drive signals on and off in accordance with the print signals. The connecting wiring between the driver IC 126 and the terminals 122 and 124 is not shown.

Figure 8:
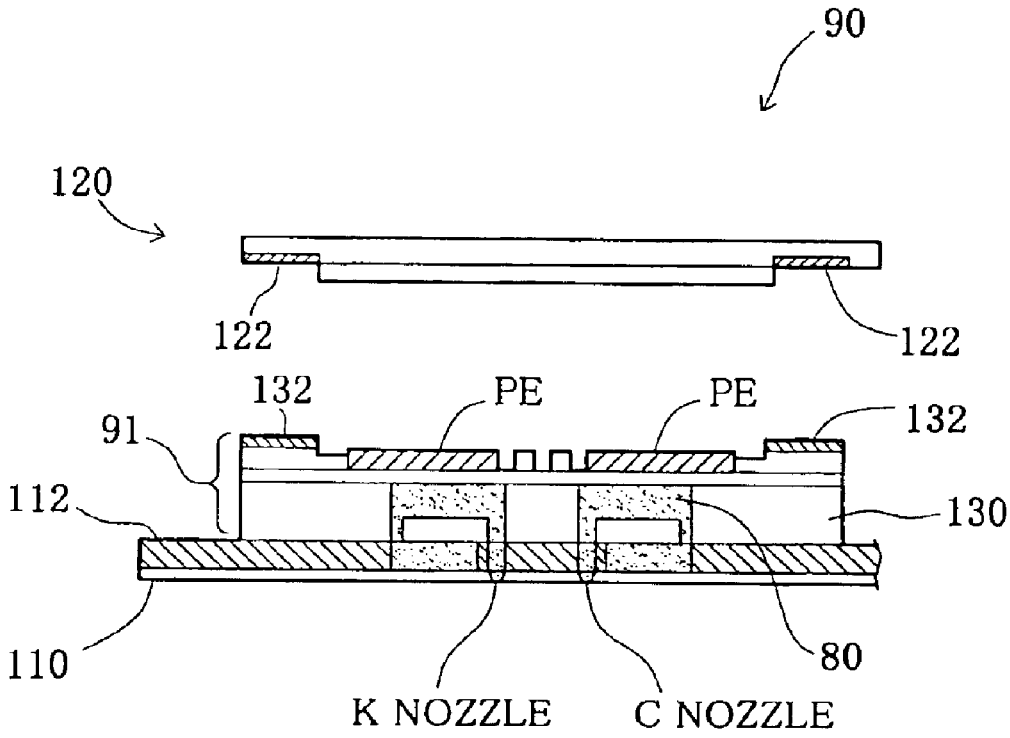
FIG. 8 is a partial cross-sectional view of the actuator circuit 90.

FIG. 8 is a partial cross-sectional view of the actuator circuit 90. This only shows the first actuator chip 91 and the terminal plate 120 in cross-section. However, the other actuator chips 92 and 93 have the same structure as that of the first actuator chip 91.

The nozzle plate 110 has nozzle openings for the inks of each color. The reservoir plate 112 is shaped to form a reservoir space to hold the ink. The actuator chip 91 has a ceramic sintered portion 130 that forms the ink passage 80 (FIG. 5), and on the other side of the upper wall over the ceramic sintered portion 130, piezoelectric elements PE and terminal electrodes 132. When the contact terminal plate 120 is affixed onto the actuator chip 91, electrical contact is formed between the contact terminals 122 on the underside of the contact terminal plate 120 and the terminal electrodes 132 on the upper side of the actuator chip 91. The connecting wiring between the terminal electrodes 132 and the piezoelectric element PE is not shown.

B. Generation of Printing Positional Deviation between Nozzle Rows:

In the first and second embodiments described below, printing positional deviation arising between rows of nozzles during bi-directional printing is adjusted. Before describing the embodiments, an explanation will be given concerning the printing positional deviation arising between nozzle rows.

Figure 9:
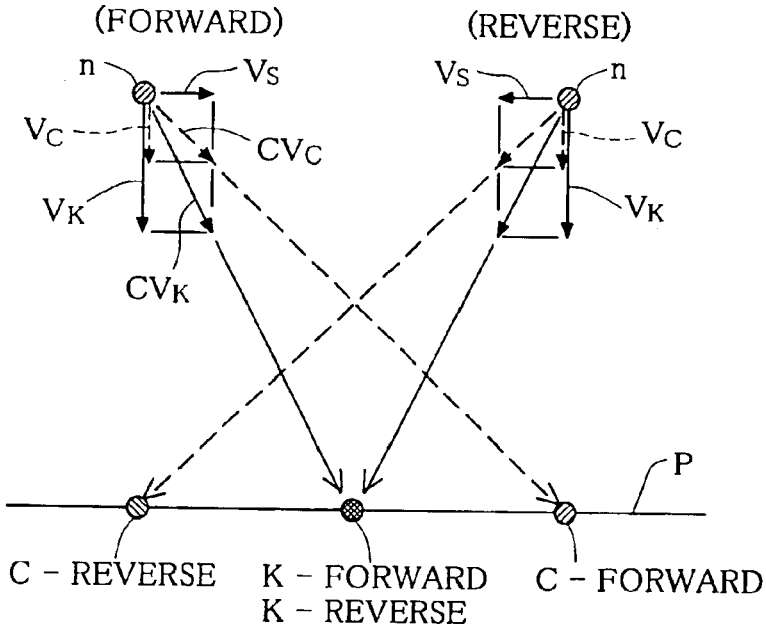
FIG. 9 illustrates positional deviation arising between rows of nozzles during bi-directional printing.

FIG. 9 illustrates positional deviation arising between rows of nozzles during bi-directional printing. Nozzle n is moved horizontally bi-directionally over the paper P with ink being emitted during forward and reverse passes to thereby form dots on the paper P. The drawing shows emission of black ink K and that of cyan ink C. $V_K$ is the emission velocity of black ink K emitted straight down, and $V_C$ is the emission velocity of cyan ink C, which is lower than $V_K$. The composite velocity vectors $CV_K$, $CV_C$ of the respective inks are given by the result of the downward emission velocity vector and the main scanning velocity $V_S$ of the nozzle n. Black ink K and cyan ink C have different downward emission velocities $V_K$ and $V_C$, so the magnitude and direction of the composite velocities $CV_K$ and $CV_C$ also differ.

In the example of FIG. 9, correction is applied so that positional deviation during bi-directional printing is reduced to zero with reference to black dots. However, since the composite velocity vector $CV_C$ of cyan ink C is different from the composite velocity vector $CV_K$ of black ink K, if the same emission timing is used for black ink K and cyan ink C, the result will be major deviation in the position of the printed cyan dots. Also, it can be seen that the relative positional relationship between black dots and cyan dots during a forward pass is reversed during the reverse pass.

Figure 10:
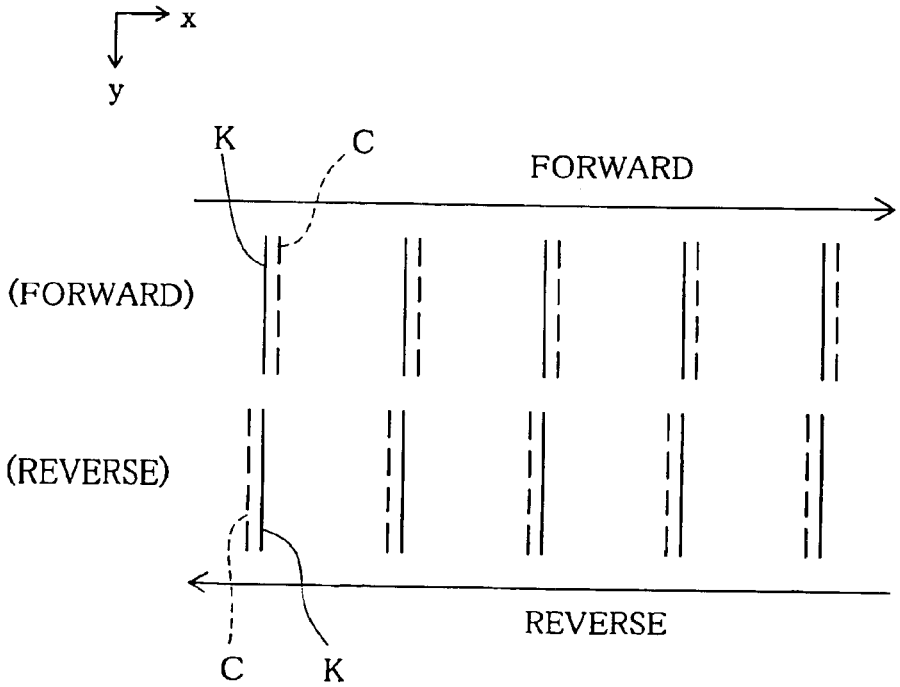
FIG. 10 is a plan view illustrating the printing positional deviation of FIG. 9.

FIG. 10 is a plan view illustrating the printing positional deviation of FIG. 9. The vertical lines in the sub-scanning direction y indicate printing in black ink K and cyan ink C. The vertical lines in black ink K printed during a forward pass are in alignment with the vertical lines printed during the reverse pass at positions in the main scanning direction x. On the other hand, the vertical lines printed in cyan ink on a forward pass are printed to the right of the black ink lines, and on the reverse pass are printed to the left of the black lines.

Thus, when positional deviation is corrected just with respect to printing by the row of black ink nozzles, there have been cases in which, with respect to other rows of nozzles, positional deviation could not be properly corrected.

The velocity of ink droplets emitted from the nozzles depends on the types of factors listed below.

(1) Manufacturing tolerance of the actuator chips.

(2) Physical qualities of the ink (viscosity, for example).

(3) Mass of ink droplets.

When the main factor affecting ink droplet emission velocity is the manufacturing tolerance of the actuator chips, the ink droplets emitted by the same actuator chip are emitted at substantially the same velocity. Therefore, in correcting for positional deviation in the main scanning direction in such a case, it is preferable to effect such correction on a nozzle group by group basis, for each group of nozzles driven by different actuators.

When the physical properties of the ink or the mass of the ink droplets have a major effect on emission velocity, it is preferable to correct for positional deviation of dots printed in the main scanning direction ink by ink or nozzle row by nozzle row.

Figure 11:
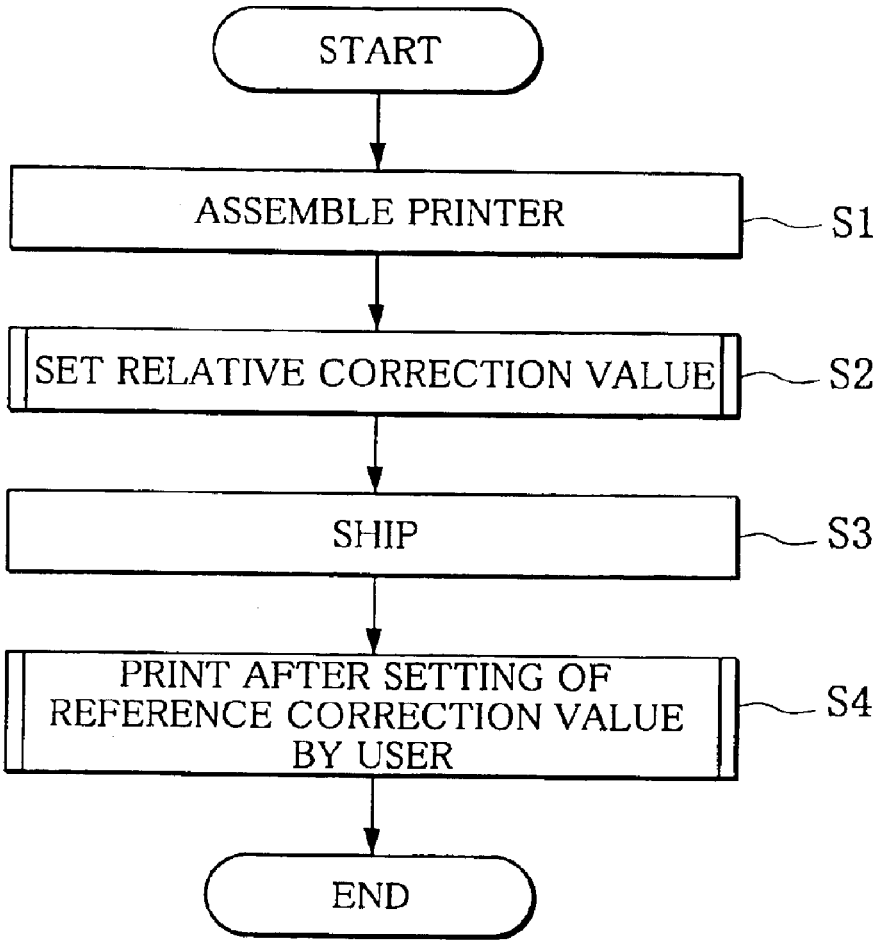
FIG. 11 is a flow chart of the overall processing by the first embodiment.

C. First Embodiment (First Example of Correcting Positional Deviation between Nozzle Rows):

FIG. 11 is a flow chart of the process steps in a first embodiment of the invention. In step S1, the printer 20 is assembled on the production line, and in step S2 an operator sets relative correction values for correcting positional deviation in the printer 20. In step S3 the printer 20 is shipped from the factory, and in step S4, the purchaser of the printer 20 prints after setting a reference correction value for correcting positional deviation during use. Steps S2 and S4 will be each described in more detail below.

Figure 12:
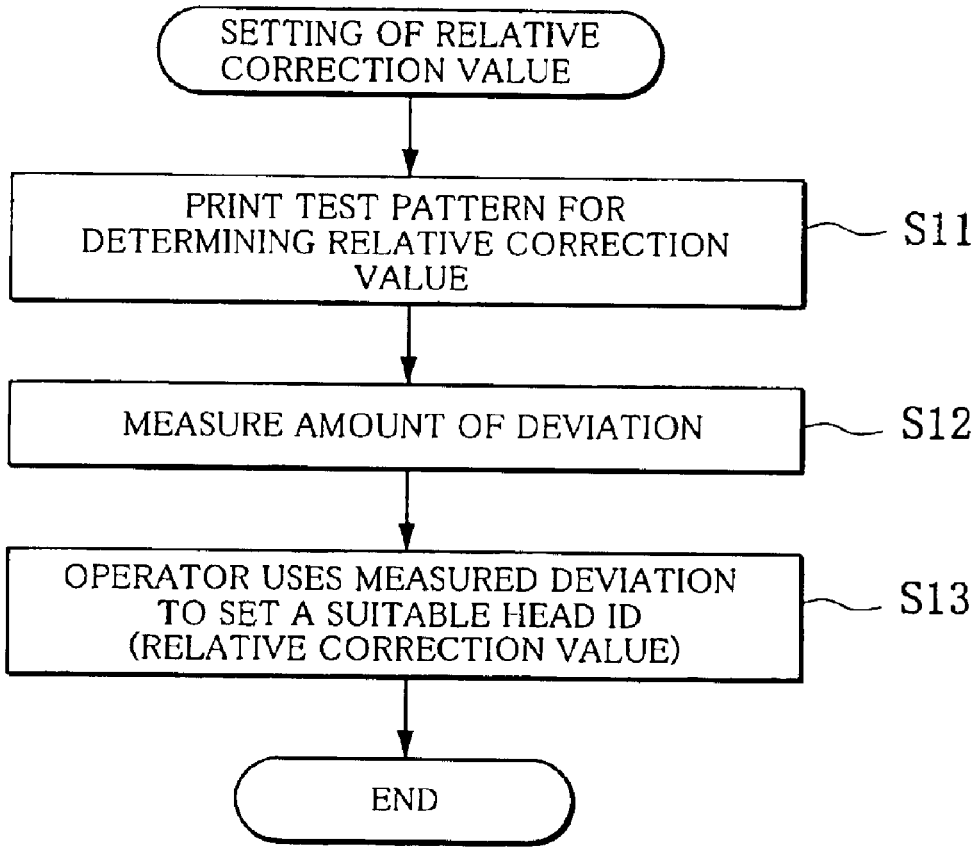
FIG. 12 is a flow chart showing the details of the step S2 procedure of FIG. 11.
Figures 13, 14:
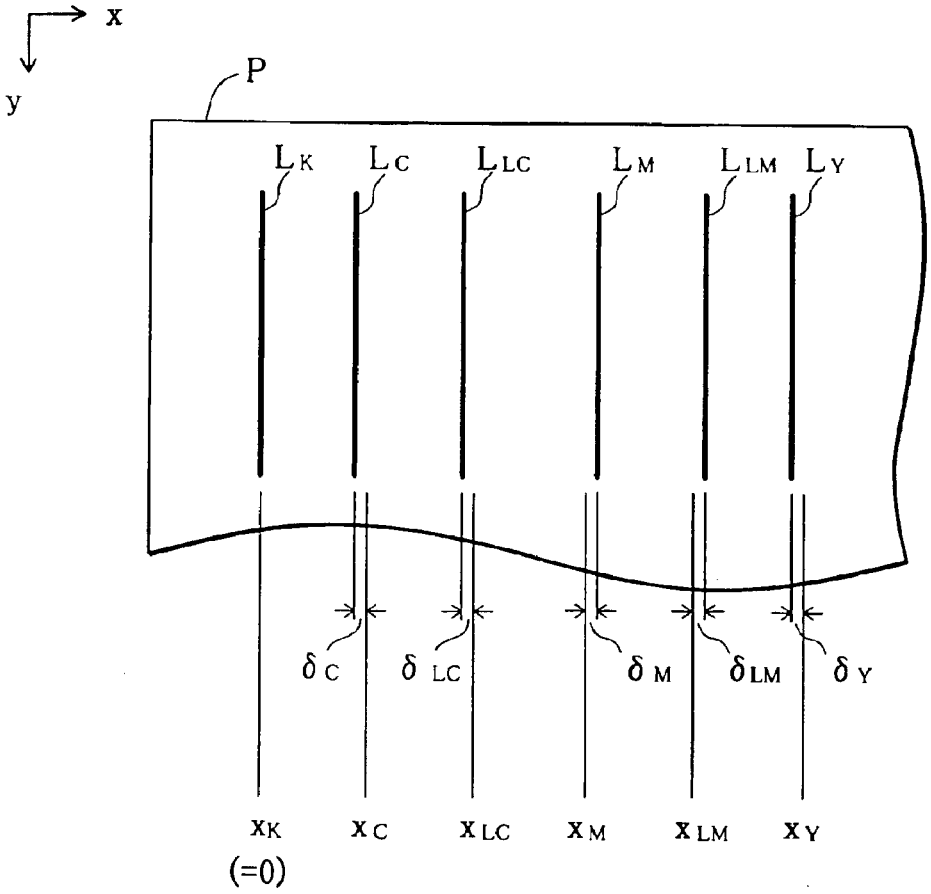
FIG. 13 is an example of a test pattern used to determine a relative correction value.
FIG. 14 shows the relationship between the relative correction value Δ and head ID.

FIG. 12 is a flow chart showing details of the step S2 of FIG. 11. In step S11, a test pattern is printed to determine relative correction values. FIG. 13 shows an example of such a test pattern. The test pattern consists of the six vertical lines $L_K$, $L_C$, $L_{LC}$, $L_M$, $L_{LM}$, $L_Y$ formed in the sub-scanning direction y in the six colors K, C, LC, M, LM, Y. The six lines were printed by ink emitted from the six rows of nozzles simultaneously while moving the carriage 30 at a set speed. In each main scanning pass the dots were formed spaced apart by just the nozzle pitch in the sub-scanning direction, so in order to print the vertical lines as shown in FIG. 13, ink was emitted at the same timing during a plurality of main scanning passes.

The test pattern does not have to be composed of vertical lines, but may be any pattern of straight lines of dots printed at intervals. This also applies to test patterns for determining a reference correction value described later.

In step S12 of FIG. 12, the amounts of deviation between the six vertical lines of FIG. 13 are measured. This can be measured by, for example, using a CCD camera to read the test pattern and using image processing to measure the positions of the lines $L_K$, $L_C$, $L_{LC}$, $L_M$, $L_{LM}$, $L_Y$ in the main scanning direction x. The six vertical lines are formed simultaneously by the emission of ink from the six rows of nozzles, so if the ink is considered as being emitted at the same velocity from the six sets of nozzles, the spacing of the six lines should be the same as the spacing of the rows of nozzles.

The x coordinates $X_C$, $X_{LC}$, $X_M$, $X_{LM}$, $X_Y$ shown in FIG. 13 indicate the ideal coordinates of the lines in accordance with the design pitches of the nozzle rows while the x coordinate value $X_K$ of the black ink line $L_K$ is used as a reference. Thus, the positions denoted by the x coordinates $X_C$, $X_{LC}$, $X_M$, $X_{LM}$, $X_Y$ will be also referred to hereinafter as the design positions. The amount of deviation $\delta_C$, $\delta_{LC}$, $\delta_{LM}$, $\delta_{LM}$, $\delta_y$ of the five lines relative to the design position is measured. When the deviation is to the right of the design position the deviation amount δ is taken as a plus value, and a minus value when the deviation is to the left of the design position.

In step S13, the measured deviation amounts are used as a basis for an operator to determine a suitable head ID and set the head ID in the printer 20. The head ID indicates the suitable relative correction value to use for correcting the measured deviations. As shown by the following equation (1), for example, the suitable relative correction value Δ can be set at a value that is the negative of the average deviation value δave of the lines other than the reference line $L_K$:

$$\Delta=-\delta ave=-\Sigma\delta i/(N-1) \quad (1)$$

where Σ denotes the arithmetical operation of obtaining the sum deviation δi of all lines other than the reference black ink line, and N denotes the total number of vertical lines, which is to say, the number of rows of nozzles.

FIG. 14 shows the relationship between relative correction value Δ and head ID. In this example, when the relative correction value Δ is −35.0 μm the head ID is set at 1, and the head ID is incremented by 1 for every 17.5 μm increase in the relative correction value Δ. Here, 17.5 μm is the minimum value by which the printer 20 can be adjusted for deviation in the main scanning direction. As this minimum adjustable value, there may be used a value that is the equivalent of the dot pitch in the main scanning direction. With respect to a printing resolution of 1440 dots per inch (dpi) in the main scanning direction, for example, the dot pitch is approximately 17.5 μm (=25.4 cm/1440), so that can be used as the minimum adjustable value. It is also possible to use a minimum adjustable value that is smaller than the dot pitch.

The head ID thus determined is stored in the PROM 43 (FIG. 2) in the printer 20. In this embodiment, a seal or label 100 showing the head ID is also provided on the top of the print head unit 60 (FIG. 3). It is also possible to provide the driver IC 126 in the print head unit 60 with a non-volatile memory, such as a PROM, and store the head ID in the non-volatile memory. The advantage of either method is that when the print head unit 60 is used in another printer 20, it enables the right head ID for that print head unit 60 to be used in the printer.

The determination of the relative correction value of step S2 can be carried out in the assembly step prior to the installation of the print head unit 60 into the printer 20, with a special inspection apparatus for testing the print head unit 60. In this case, the head ID can be stored in the PROM 43 during the subsequent installation of the print head unit 60 in the printer 20. In this case, the head ID can be stored in the PROM 43 of the printer 20 by using a special reader to read the head ID seal 100 on the print head unit 60 or an operator can use a keyboard to manually key in the head ID. alternatively, the head ID stored in non-volatile memory in the print head unit 60 can be transferred to the PROM 43.

The relative correction value Δ may be given by the average of the light cyan and light magenta deviation amounts, as in equation (2):

$$\Delta=-(\delta_{LC}+\delta_{LM})/2 \quad (2)$$

Light cyan and light magenta are used far more than other inks in halftone regions of color images (especially in the image density range of about 10 to 30% for cyan and/or magenta), so the positional precision of dots printed in these colors has a major effect on the image quality. Thus, using the average deviation of dots printed in light cyan and light magenta to determine the relative correction value Δ makes it possible to decrease the positional deviation, thereby improving the quality of the color images.

When using equation (2), it is enough just to measure the deviation δ from the black ink dots for light cyan and light magenta.

As shown in the flow chart of FIG. 11, the printer 20 is shipped after the head ID has been set in the printer 20. When the printer 20 is to be used, positional deviation during bi-directional printing is adjusted using the head ID.

Figure 15:
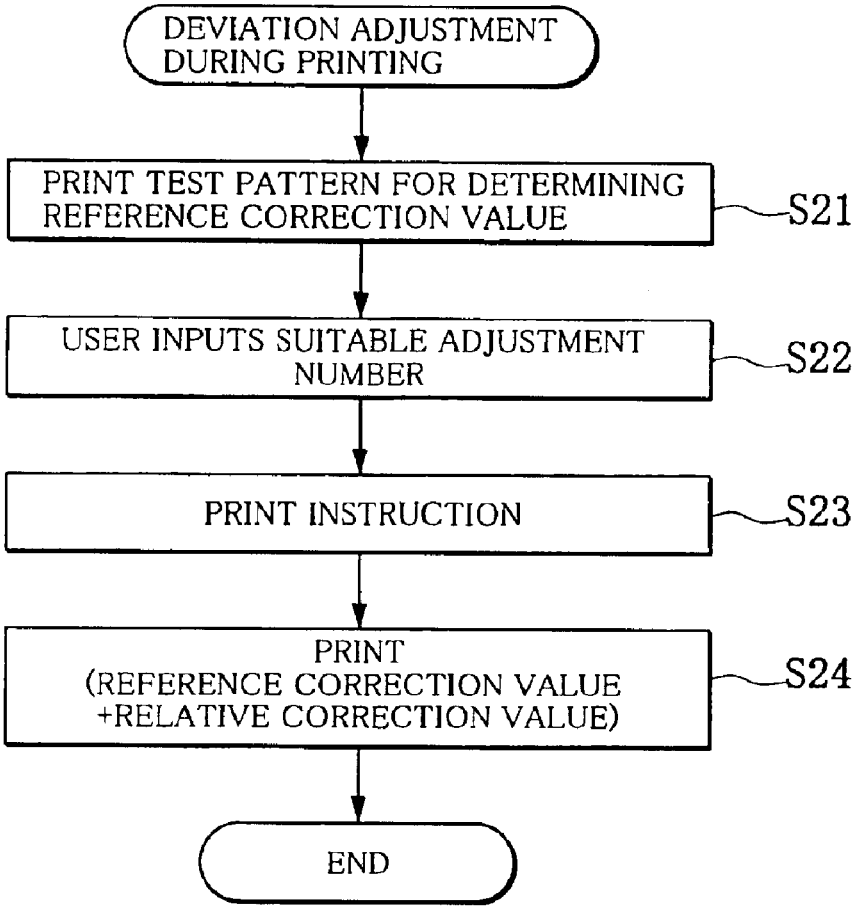
FIG. 15 is a flow chart showing the details of the step S4 procedure of FIG. 11.
Figure 16:
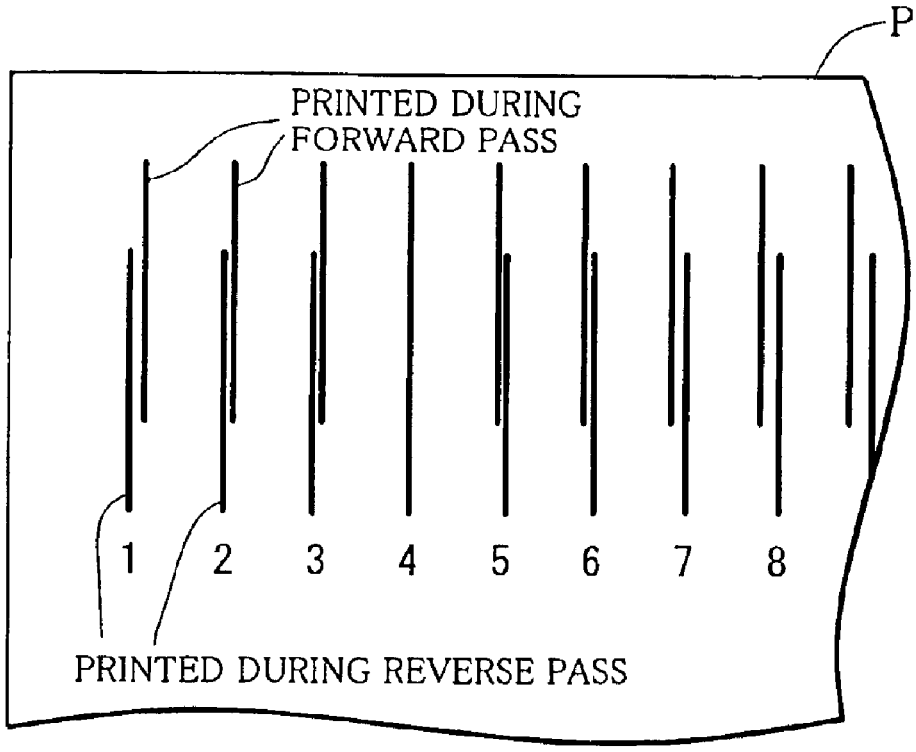
FIG. 16 is an example of a test pattern used to determine a reference correction value.

FIG. 15 is a flow chart of the deviation adjustment procedure carried out when the printer is used by the user. In step S21 the printer 20 is instructed to print out a test pattern to determine a reference correction value. FIG. 16 shows an example of such a test pattern. The test pattern consists of a number of vertical lines printed in black ink during forward and reverse passes. The lines printed during the forward pass are evenly spaced, but on the reverse pass the position of the lines is sequentially displaced along the main scanning direction in units of one dot pitch. As a result, multiple pairs of vertical lines are printed in which the positional deviation between lines printed during the forward and reverse passes increases by one dot pitch at a time. The numbers printed below the pairs of lines are deviation adjustment numbers denoting correction information required to achieve a preferred corrected state. A preferred corrected state refers to a state in which, when the printing position (and printing timing) during forward and reverse passes has been corrected using an appropriate reference correction value, the positions of dots formed during forward passes coincide with the positions of dots formed during reverse passes with respect to the main scanning direction. Thus, the preferred corrected state is achieved by the use of an appropriate reference correction value. In the example of FIG. 16, the pair of lines with the deviation adjustment number 4 are in a preferred corrected state.

The test pattern for determining the reference correction value is formed by a reference row of nozzles which has been used for determining the relative correction value. Therefore, when the row of magenta ink nozzles is used as the reference nozzle row in place of the row of black ink nozzles used for determining the relative correction value, the test pattern for determining the reference correction value is also formed using the row of magenta ink nozzles.

The user inspects the test pattern and uses a printer driver input interface screen (not shown) on the computer 88 to input the deviation adjustment number of the pair of vertical lines having the least deviation. The deviation adjustment number is stored in the PROM 43.

Figure 17:
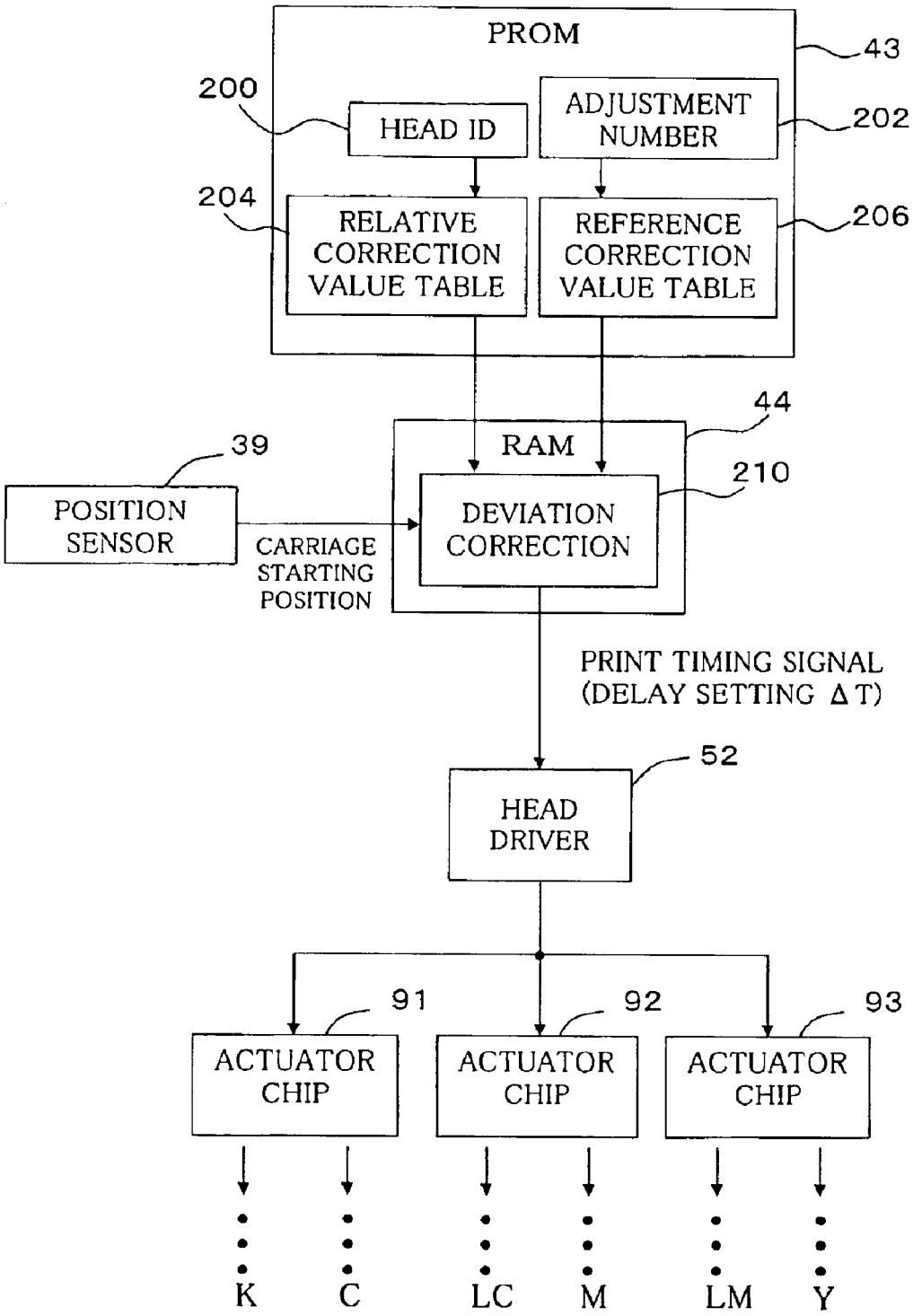
FIG. 17 is a block diagram of the main configuration involved in the correction of deviation arising during bi-directional printing in the case of the first embodiment.

Next, in step S23, the user instructs to start the printing, and in step S24, bi-directional printing is carried out while using the reference and relative correction values to correct deviation. FIG. 17 is a block diagram of the main configuration involved in the correction of deviation during bi-directional printing in the case of the first embodiment. The PROM 43 in the printer 20 has a head ID storage area 200, an adjustment number storage area 202, a relative correction value table 204 and a reference correction value table 206. A head ID indicating the preferred relative correction value is stored in the head ID storage area 200, and a deviation adjustment number indicating the preferred reference correction value is stored in the adjustment number storage area 202. The relative correction value table 204 is one such as that shown in FIG. 14, which shows the relationship between head ID and relative correction value Δ. The reference correction value table 206 is a table showing the relationship deviation adjustment number and reference correction value.

The RAM 44 in printer 20 is used to store a computer program that functions as a positional deviation correction section (adjustment value determination section) 210 for correcting positional deviation during bi-directional printing. The deviation correction section 210 reads out from the relative correction value table 204 a relative correction value corresponding to the head ID stored in the PROM 43, and also reads out from the reference correction value table 206 a reference correction value corresponding to the deviation adjustment number. During a reverse pass, when the deviation correction section 210 receives from the position sensor 39 a signal indicating the starting position of the carriage 30, it supplies the head drive circuit 52 with a printing timing signal (delay setting ΔT) that corresponds to a correction value that is a composite of the relative and reference correction values. The three actuator chips 91 to 93 in the head drive circuit 52 are supplied with common drive signals, whereby the positioning of dots printed during the reverse pass is adjusted in accordance with the timing supplied from the deviation correction section 210 (that is, by a delay setting ΔT). As a result, on the reverse pass, the printing positions of the six rows of nozzles are all adjusted by the same correction amount. When relative and reference correction amounts are both set at values that are integer multiples of the dot pitch in the main scanning direction, the printing position (meaning the printing timing) also is adjusted in dot pitch units in the main scanning direction. The composite correction value is obtained by adding the reference and relative correction values.

Figure 18A:
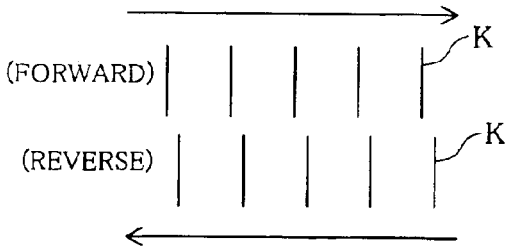
FIGS. 18(A)–18(D) illustrate the correction of positional deviation using reference and relative correction values, when black dots and cyan dots have been selected as the target dots.
Figure 18B:
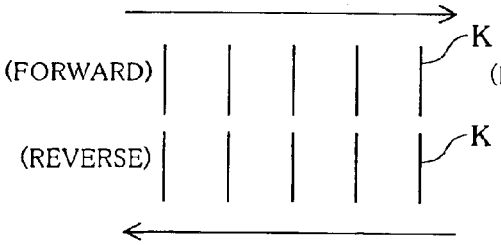
Figure 18C:
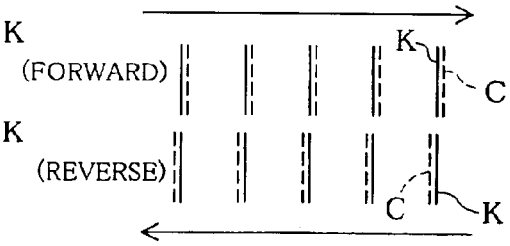
Figure 18D:
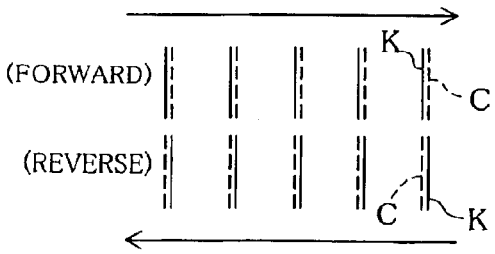

FIGS. 18(A)–18(D) illustrate the correction of positional deviation using reference and relative correction values. FIG. 18(A) shows deviation between vertical lines of black ink dots printed during forward and reverse passes without correction of the positional deviation. FIG. 18(B) shows the result of the positional deviation correction of the black lines using a reference correction value. Thus, correction using the reference correction value eliminated positional displacement of the black-dot lines during bi-directional printing. FIG. 18(C) shows the result of lines printed in cyan as well as black, using the same adjustment as in FIG. 18(B). As in FIG. 10, there is no deviation of the black lines, but there is quite a lot of deviation of the cyan lines. FIG. 18(D) shows black lines and cyan lines printed after correction based on a reference correction value and after also applying a relative correction value Δ (=$-\delta_C$) to the cyan dots. This reduced deviation of the cyan dots, and slightly causes the deviation of the black dots. The overall result is that positional deviations of both black dots and cyan dots are decreased to be at about the same degree. In the example of FIG. 18(D), black dots and cyan dots were selected as the target dots to be subjected to positional correction, and correction of positional deviation is applied to those two types of dots.

Figure 19A:
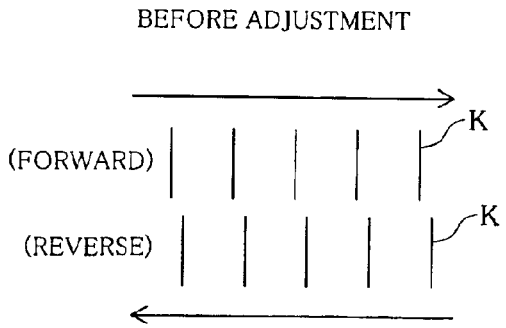
FIGS. 19(A)–19(D) illustrate the correction of positional deviation using reference and relative correction values, when only cyan dots have been selected as the target dots.
Figure 19B:
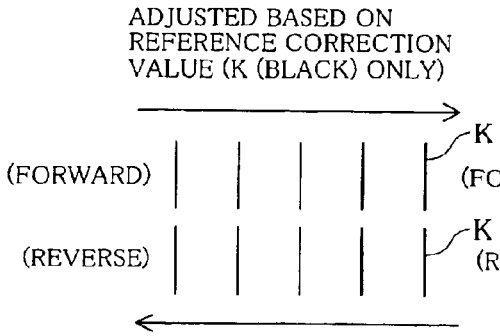
Figure 19C:
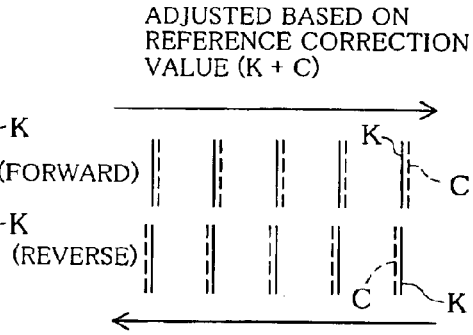
Figure 19D:
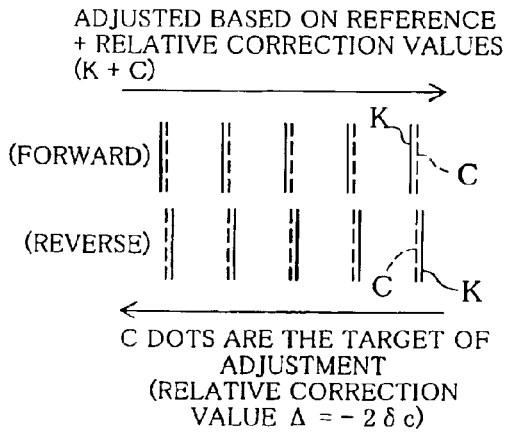

FIGS. 19(A)–19(D) illustrate correction of positional deviation applied to cyan dots only. The reference correction value used in FIG. 19(A) to FIG. 19(C) were the same as those applied in FIG. 18(A) to FIG. 18(C), while the value used in FIG. 19(D) differed from that used in FIG. 18(D). In the case of FIG. 19(D), the relative correction value Δ there is an inversion of twice the deviation amount $\delta_C$ of the cyan dots, or $-2\delta_C$, determined with the test pattern shown in FIG. 13. While this increases the deviation of the black dots, it reduces positional deviation of cyan dots to virtually to zero.

As can be understood from the examples shown in FIGS. 18(A)–18(D) and FIGS. 19(A)–19(D), when the deviation amount $-\delta$ of specific dots in the test pattern for determining relative correction values is used as the relative correction value Δ, both the specified dots and the reference dots (black dots) become the target dots for positional deviation correction, thereby making it possible to reduce positional deviation of these target dots. When twice the deviation amount $-\delta$ of specific dots of the test pattern for determining the relative correction value is used as the relative correction value Δ, only the specific dots are targeted for the positional deviation correction, making it possible to reduce the positional deviation of the target dots. Specifically, using the relative correction value Δ (=$-(\delta_{LC}+\delta_{LM})/2$) of equation (2) makes it possible to reduce positional deviations to be at the same degree in respect of three types of dots, black, light cyan and light magenta. Moreover, when the double value is used as the relative correction value, it is possible to reduce positional deviations to be at the same degree in respect of two types of dots, light cyan and light magenta. Similarly, when the relative correction value Δ (=$-\delta$ave) of equation (1) is used, it becomes possible to reduce positional deviations to be at the same degree in respect of all six types of dots. Also, when the double value is used as the relative correction value, it is possible to reduce positional deviations to be at the same degree in respect of all types of dots other than the black dots.

As revealed by FIG. 18(D) and FIG. 19(D), adjusting positional deviation based on the reference and relative correction values improves the quality of the color images by preventing the positional deviation of the dots of colored inks from becoming excessively large.

In monochrome printing colored inks are not used, so there is no need for the type of positional adjustment correction using relative correction values as shown in FIG. 18(D) and FIG. 19(D). Thus, in the case of monochrome printing it is preferable to apply deviation correction using just a reference correction value, as shown in FIG. 18(B). Thus, it is preferable to use a configuration whereby when the computer 88 instructs the printer control circuit 40 (specifically, the deviation correction section 210 shown in FIG. 17) to print in monochrome, just a reference correction value is used to correct positional deviation during bi-directional printing, and when the instruction is to print in color, both a reference correction value and a relative correction value are used to correct positional deviation during bi-directional printing.

When it becomes necessary, for whatever reason, to replace the print head unit 60, the head ID of the new print head unit 60 is written into the PROM 43 in the control circuit 40 of the printer 20. This can be done in a number of ways. One way is for the user to use the computer 88 to input the head ID displayed on the head ID seal 100 attached to the print head unit 60 to the PROM 43. Another method is to retrieve the head ID from the non-volatile memory of the driver IC 126 (FIG. 7) and write it into the PROM 43. Thus storing-in-the PROM 43-the head ID of the new print head unit 60 ensures that positional deviation during bi-directional printing will be corrected using the suitable head ID (that is, the suitable relative correction value) for that print head unit 60.

As described in the foregoing, in accordance with this first embodiment a relative correction value is set for correcting positional deviation arising during bi-directional printing, with the row of black ink nozzles forming the reference for adjustment carried out in respect of the other rows of nozzles. Thus, this relative correction value and the reference correction value for black ink nozzles are used to correct positional deviation during bi-directional printing, thereby making it possible to improve the quality of the printed color images. An advantage is that a user does not have to make adjustments to correct positional deviation in respect of all inks, but only has to adjust for positional deviation in respect of the reference row of nozzles to achieve improved image quality during bi-directional printing of color images. In the case of monochrome printing, it is only necessary to use a reference correction value to correct for positional deviation during bi-directional printing, which is advantageous in that there is no degradation in the monochrome printing.

Figure 20:
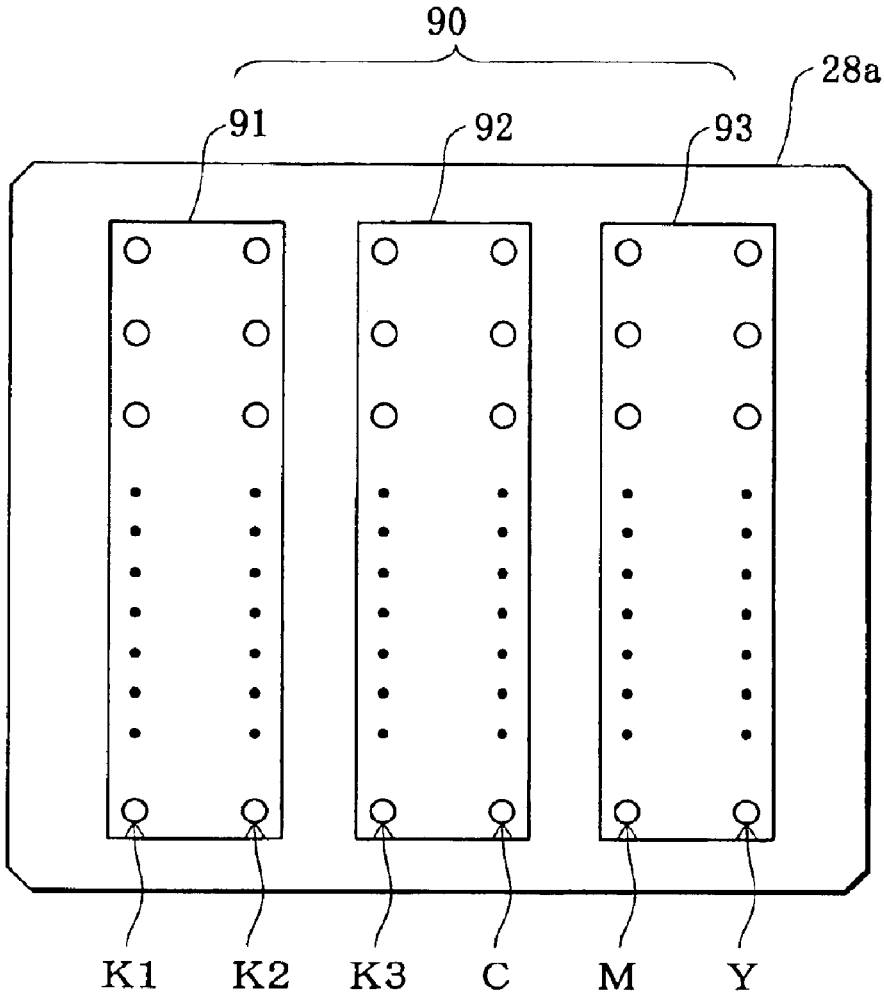
FIG. 20 illustrates the configuration of another print head 28*a*.

FIG. 20 illustrates another configuration of print head nozzles. In this example, print head 28*a* is provided with three rows of black (K) ink nozzles K1 to K3, and one row each of cyan (C), magenta (M) and yellow (Y) ink nozzles. During monochrome printing, the three rows of black ink nozzles can all be used, enabling high-speed printing. During color printing, the two rows of black ink nozzles K1 and K2 of the actuator chip 91 are not used, with printing being performed using the row of black ink nozzles K3 of actuator chip 92, together with the rows of cyan, magenta and yellow ink nozzles C, M and Y.

When printing in color using this head, the average of the cyan and magenta deviation amounts, or a value that is twice that value, as derived by equations (3a) and (3b), may be used as the relative correction value Δ during bi-directional color printing:

$$\Delta=-(\delta_C+\delta_M)/2 \tag{3a}$$

$$\Delta=-(\delta_C+\delta_M) \tag{3b}$$

$\delta_C$ and $\delta_M$ are relative deviation amounts for cyan and magenta measured from the vertical lines in the test pattern (FIG. 13) for determining the relative correction value while using the third row K3 of black ink nozzles as a reference.

When performing four-color printing without light inks, it is possible to improve the quality of the color images by using the average of the cyan and magenta deviation amounts to determine the relative correction value. The reason that yellow is disregarded is that yellow dots are not very noticeable, so that even if there is some deviation of yellow dots during bi-directional printing, this does not have any major effect on the image quality. However, the relative correction value may be determined based on the average of the cyan, magenta and yellow deviation amounts. That is to say, the relative correction value may be determined that is based on the average of the deviation amounts of all the rows of nozzles other than the reference row.

The relative correction value ΔK for non-reference black ink nozzle rows K1 and K2 with respect to the reference black ink nozzle row K3 may be obtained, in accordance with equation (4):

$$\Delta K=-(\delta_{K1}+\delta_{K2})/2 \tag{4}$$

where $\delta_{K1}$ is the deviation amount of the black dots formed with the row K1 and $\delta_{K2}$ is that of the black dots formed with the row K2.

Positional deviation arising during bi-directional monochrome printing using the three rows of black ink nozzles can be decreased by correcting deviation during bi-directional printing using relative correction value ΔK in respect of rows K1 and K2 and the reference correction value in respect of the reference row K3 (determined in FIG. 15). That is, when printing in monochrome using multiple rows of black ink nozzles, it is desirable to correct positional deviation during bi-directional printing by using a reference correction value in respect of a specific reference row of black ink nozzles, and a relative correction value in respect of the other rows of black ink nozzles.

Figure 21:
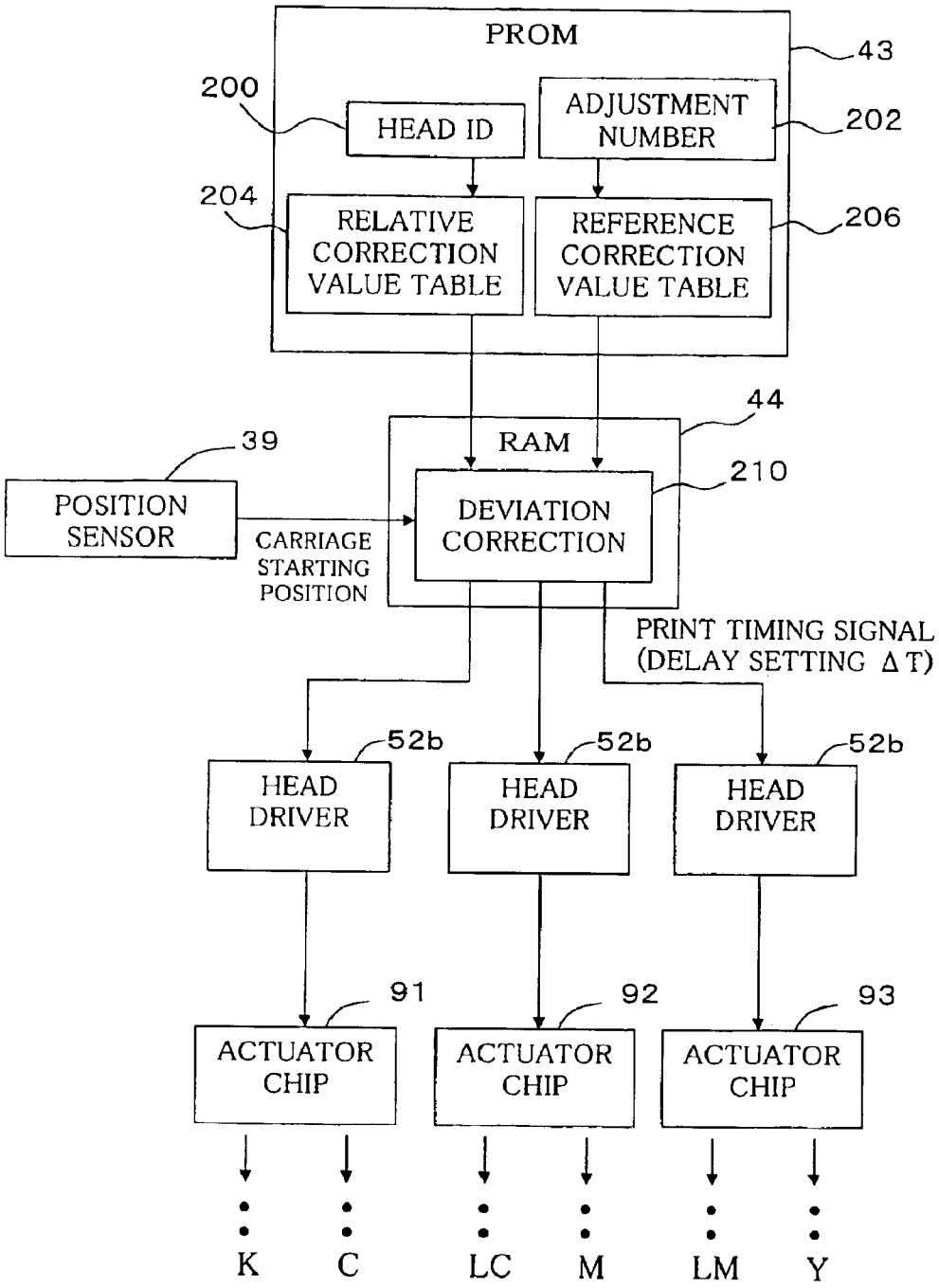
FIG. 21 is a block diagram of a control circuit 40*a* used in a second embodiment.

D. Second Embodiment (Second Example of Correcting Positional Deviation between Nozzle Rows):

FIG. 21 is a block diagram of the main configuration involved in the correction of deviation during bi-directional printing in the second embodiment. The difference compared to the configuration of FIG. 17 is that each of the actuator chips 91, 92 and 93 is provided with its own, independent head drive circuit 52*a*, 52*b* and 52*c*. Thus, printing timing signals from the deviation correction section 210 can be independently applied to the head drive circuits 52*a*, 52*b* and 52*c*. Therefore, correction of positional deviation during bi-directional printing can also be effected on an actuator chip by chip basis.

In this second embodiment, too, the row K of black ink nozzles of the first actuator chip 91 is used as the reference. Thus, as in the first embodiment, the reference correction value is determined using a test pattern printed using the the row K of black ink nozzles.

In this second embodiment a relative correction value is determined for each actuator chip. That is, as the relative correction value $\Delta_{91}$ for the first actuator chip 91, there can be used a value that is the negative of the deviation amount $\delta_C$ of the vertical lines printed using the row C of dark cyan nozzles, as per equation (4a):

$$\Delta_{91}=-\delta_C \tag{4a}$$

Also, as the relative correction values $\Delta_{92}$, $\Delta_{93}$ for the second and third actuator chips 92 and 93, there can be used values that are each the negative of the average deviation of the nozzle rows of each actuator chip, as per the following equations (4b) and (4c):

$$\Delta_{92}=-(\delta_{LC}+\delta_M)/2 \tag{4b}$$

$$\Delta_{93}=-(\delta_{LM}+\delta_Y)/2 \tag{4c}$$

Also, the relative correction values $\Delta_{92}$ and $\Delta_{93}$ for the second and third actuator chips 92 and 93 may be determined from the amount of printing positional deviation of one specific nozzle row from the reference nozzle row. In such a case, equations (5b) and (5c) can be used in place of equations (4b) and (4c):

$$\Delta_{92}=-\delta_{LC} \tag{5b}$$

$$\Delta_{92}=-\delta_{LM} \tag{5c}$$

The head ID representing the three relative correction values $\Delta_{91}$, $\Delta_{92}$ and $\Delta_{93}$ are stored in the PROM 43 of the printer 20. The deviation correction section 210 is supplied with the relative correction values $\Delta_{91}$, $\Delta_{92}$ and $\Delta_{93}$ corresponding to this head ID. Instead of equations (4a) to (5c), a value that is twice the value of the right-side term of the equations can be used as the relative correction value.

The second embodiment described above is characterized in that a relative correction value can be independently set for each actuator chip. This makes it possible to correct the relative positional deviation from the row of reference nozzles on an actuator chip by chip basis, enabling the positional deviation during bi-directional printing to be further decreased. Also, in the type of printer in which one actuator chip is used to drive three rows of nozzles, a relative correction value can be set independently for each three rows of nozzles.

From the viewpoint of improving the image quality of halftone regions, it is preferable to select light cyan dots and light magenta dots as target dots for positional deviation adjustment to reduce the positional deviation of those dots. However, when color printing is performed using M types of ink (where M is an integer of two or more), dots of specific inks having a relatively low density (which is to say, particular inks other than black) among the M types of dots can be selected as the target dots and the working principle of the first and second embodiments can be applied to reduce the positional deviation of those target dots.

E. Third Embodiment (Correction of Positional Deviation Between Dots of Different Sizes):

In the first and second embodiments described in the foregoing, printing positional deviation between rows of nozzles is corrected. In the third embodiment described below, printing positional deviation between dots of different sizes is corrected.

Figure 22A:
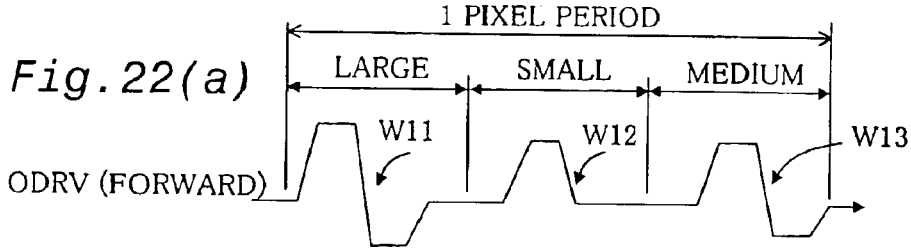
FIGS. 22(*a*) and 22(*b*) show the waveforms of a base drive signal ODRV used in a third embodiment.
Figure 22B:
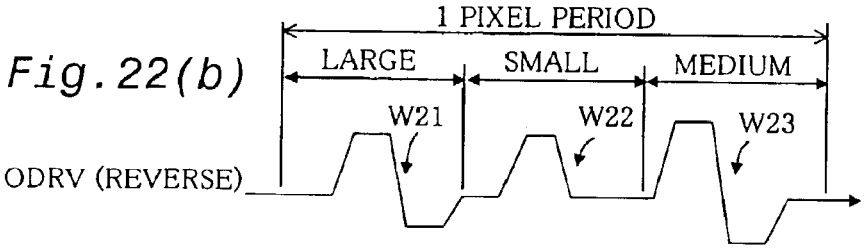

FIGS. 22(*a*) and 22(*b*) illustrate the waveform of a base drive signal ODRV that is supplied from the head drive circuit 52 (FIG. 2) to the print head 28. During a forward pass, in a single pixel period, the base drive signal ODRV generates a large dot waveform W11, a small dot waveform W12 and a medium dot waveform W13, in that order. And during a reverse pass, in a single pixel period, a medium dot waveform W21, a small dot waveform W22 and a large dot waveform W23 are generated, in that order. During a forward pass or a reverse pass, any one of the three waveforms can be selectively used to print a large, small or medium dot at a pixel position.

Figure 23:
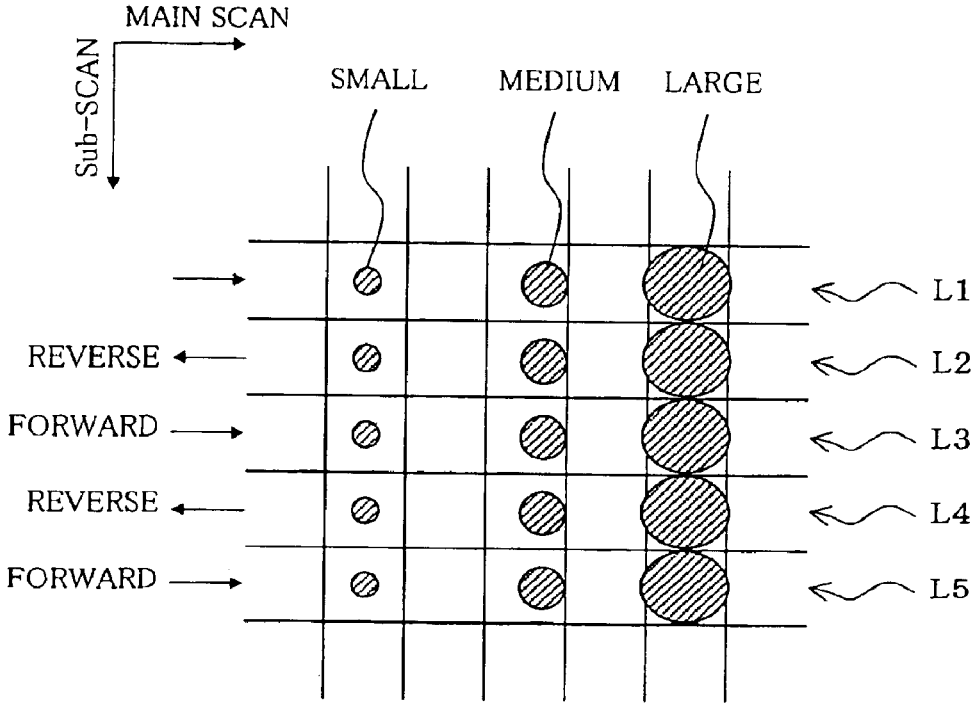
FIG. 23 shows the three types of dots formed in the third embodiment.

The different orders of the large, medium and small dot waveforms in the forward and reverse passes substantially match the dot positions in the main scanning direction. FIG. 23 shows the three types of dots formed using the base drive signals ODRV shown in FIG. 22. The grid of FIG. 23 shows pixel areas; that is, each square of the grid corresponds to the area of a single pixel. The dot inside each pixel area is printed by ink droplets emitted by the print head 28 as the print head 28 is moved in the main scanning direction. In the example of FIG. 23, odd numbered raster lines L1, L3, L5 are printed on a forward pass and even numbered raster lines L2, L4 are printed on a reverse pass. By adjusting the amount of ink emitted on a pixel by pixel basis, at each pixel position it is possible to form dots of any of the three different sizes.

Small dots formed in either a forward pass or a reverse pass are located more or less in the center of a pixel region. Medium dots are formed on the right side of a pixel region, while large dots take up substantially the whole of a pixel region. Using the base drive signals ODRV shown in FIGS. 22(*a*) and 22(*b*) makes it possible to obtain a substantial match between the point of impact of ink droplets emitted during a forward pass and the point of impact of ink droplets emitted during the reverse pass. In practice, of course, some positional deviation will arise between dots printed bi-directionally, which is why it is necessary to make positional adjustments.

Figure 24:
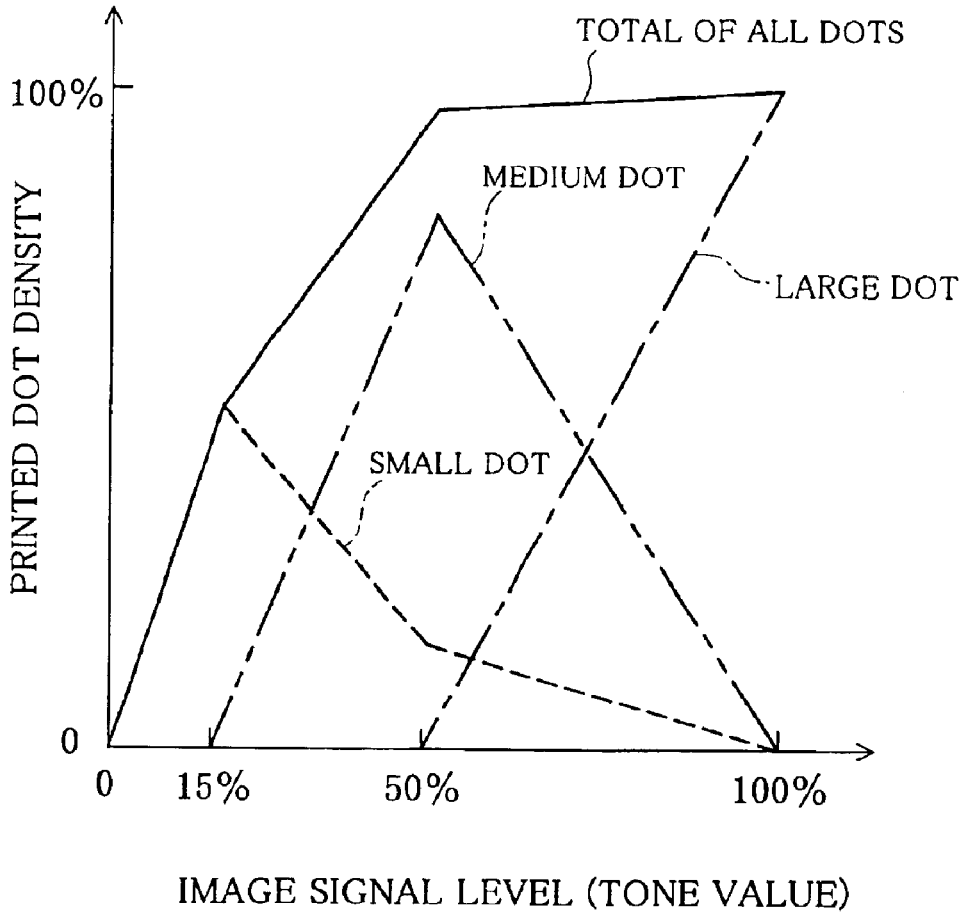
FIG. 24 is a graph illustrating a method of reproducing halftones using the three types of dots.

FIG. 24 is a graph illustrating a method of reproducing halftones using the three types of dots. In FIG. 24 the horizontal axis is the relative image signal level and the vertical axis is the printed dot density. Here, printed dot density refers to the proportion of the pixel positions in which dots are formed. For example, in a region containing 100 pixels in which dots are formed at 40 pixel positions, the printed dot density is 40%. The image signal level corresponds to a halftone value indicating image density level.

In the graph of FIG. 24, in a halftone range in which the image signal level is from 0% to 16%, the printed dot density of small dots increases linearly from 0% to about 50% with the increase in image signal level. As a result, at an image portion in which the image signal level is about 16%, small dots are formed at about half the dot positions. In a halftone range in which the image signal level is from about 16% to about 50%, the printed dot density of small dots decreases linearly from about 50% to about 15% with the decrease in image signal level, while the printed dot density of medium dots increases linearly from 0% to about 80%. In a halftone range in which the image signal level is from about 50% to 100%, the printed dot density of small and medium dots decreases linearly down to 0% with the increase in image signal level, while the printed dot density of large dots increases linearly from 0% to 100%. Thus, by using one or two types of dots to print each portion of the image in accordance with the image signal level of that image portion, it is possible smoothly to linearly reproduce the density levels of an image.

Deviation between printing positions on a forward pass and printing positions on the reverse pass are readily noticeable in halftone regions where the tone range is up to about 50% (especially in a range of about 10% to about 50%). Deviation between the printing positions on a forward pass and the printing positions on the reverse pass in the case of medium and small dots, which are used extensively in halftone regions, tends to be readily noticeable in images in halftone regions.

A problem that arises when a test pattern for adjusting positional deviation arising in bi-directional printing is printed using medium or small dots is that a user finds it difficult to perceive positional deviation in the test pattern. Therefore, a test pattern that is to be used for adjustment by a user should be printed using large dots. In the third embodiment, taking all this into consideration, when a user is to be making the adjustments, the reference correction value for correcting positional deviation is set using a test pattern printed using large dots. Moreover, correcting this reference correction value using a relative correction value determined beforehand makes it possible to effect adjustment during printing that reduces printing positional deviation of small and medium dots.

The process sequence used in the third embodiment is the same as that used in the first embodiment described with reference to FIGS. 11, 12 and 15. However, the test pattern used to determine relative correction values differs from that used in the first embodiment.

Figure 25:
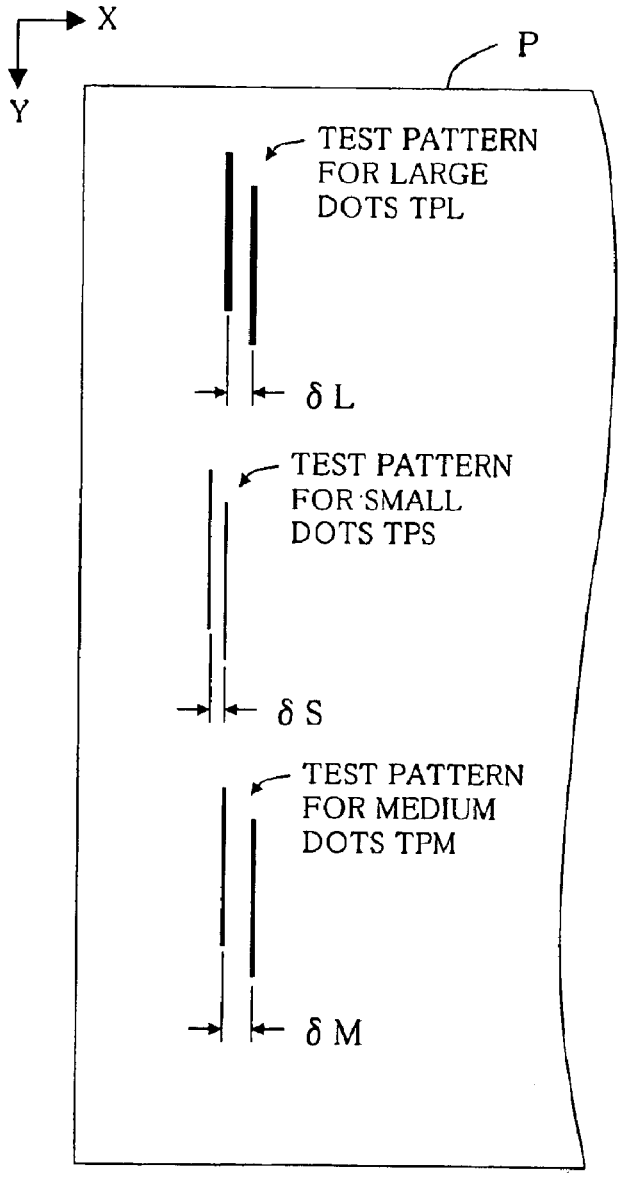
FIG. 25 shows an example of a test pattern used for determining relative correction values in the third embodiment.

FIG. 25 shows an example of a test pattern used for determining relative correction values. The test pattern printed on paper P includes a test pattern TPL for large dots, a test pattern TPS for small dots and a test pattern TPM for medium dots. The three test patterns TPL, TPS and TPM each comprise a pair of vertical lines formed in black ink in forward and reverse passes by the printer. To facilitate accurate measurement of the lines, it is desirable to form the lines as straight lines one dot in width.

In the third embodiment, the deviation measurement of step S12 (FIG. 12) is carried out by measuring the amount of deviation δL, δS and δM between the lines of the test patterns TPL, TPS and TPM of FIG. 25 printed on a forward pass and the lines printed on the reverse pass. This can be done by using a CCD camera, for example, to read the test pattern images and processing the images to measure the positions of the lines in the main scanning direction x.

In step S13, the deviation amounts δL, δS and δM thus measured are used to determine relative correction values which are then stored in PROM 43 in the printer 20. The relative correction value is the differential between the amount of deviation with respect to reference dots and the amount of deviation with respect to dots other than the reference dots. When large dots are used as the reference dots, relative correction value ΔS for small dots and relative correction value ΔM for medium dots are given by the following equations (6a) and (6b):

$$\Delta S=(\delta S-\delta L) \tag{6a}$$

$$\Delta M=(\delta M-\delta L) \tag{6b}$$

Instead of relative correction values ΔS, ΔM, the three deviation amounts δL, δS, δM may be stored in the printer PROM 43. Thus, it does not matter as long as information is stored in the PROM that substantially represents the relative correction value. It is not necessary to store relative correction values for all the other dots other than the reference dots in the PROM 43, so long as there is at least one such value stored therein (ΔS, for example).

The test patterns for each of the dots may be comprised of multiple pairs of vertical lines. In such a case, the average positional deviation of the pairs of vertical lines for each type of dot can be employed as the printing positional deviation amount for the dots concerned. Instead of vertical lines, a pattern can be used comprised of straight lines formed by dots printed intermittently.

Moreover, a part of the test pattern may be printed in chromatic color ink, meaning a color other than black, such as magenta, light magenta, cyan, light cyan, and so forth. For example, the large dot test pattern TPL could be printed in black ink and the small and medium test patterns TPS and TPM could be printed in color. In a color image, small and medium chromatic color dots have a major effect on the quality of halftone image portions. This means that the quality of halftone image portions of color images can be improved by using a relative correction value for small or medium dots of chromatic color ink.

In the third embodiment, the test pattern for determining reference correction values, shown in FIG. 16, consists of multiple pairs of vertical lines printed with large dots of black ink during forward and reverse passes.

Test patterns for determining reference correction values are formed using the reference dots employed to determine relative correction values. This means that if the reference dots used in determining relative correction values are large magenta dots instead of large black dots, the test pattern for determining reference correction values will also be formed using large magenta dots.

A test pattern that is to be used for adjustment of the positional deviation by a user should be printed using large dots as the reference dots. This is advantageous in that it makes it easier for the user to perceive positional deviation in the test pattern, thereby enabling more accurate adjustment.

Figure 26A:
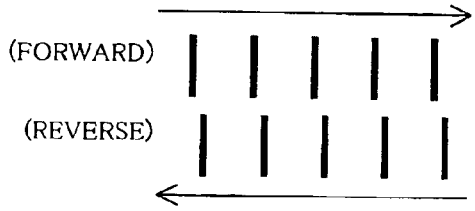
FIGS. 26(A)–26(D) illustrate the positional deviation correction implemented in the third embodiment.
Figure 26B:
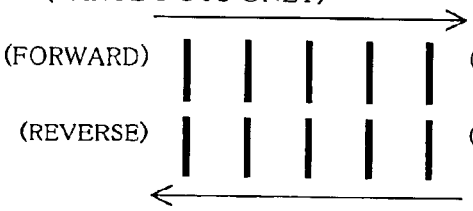
Figure 26C:
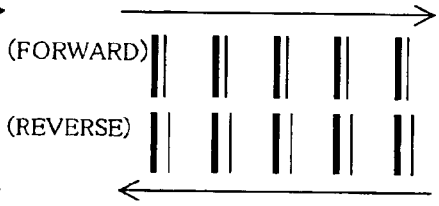
Figure 26D:
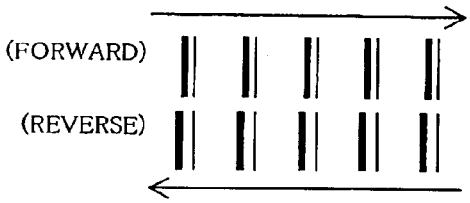

In the third embodiment, too, positional adjustment is implemented using the same configuration shown in FIG. 17 or FIG. 21. FIGS. 26(A)–26(D) illustrate the positional deviation adjustment implemented in the third embodiment. FIG. 26(A) shows deviation between vertical lines formed of large dots (reference dots) printed during forward and reverse passes without the adjusting to correct the positional deviation. FIG. 26(B) shows the hypothetical result of using a reference correction value to correct the positional deviation of the large dots. Thus, correction using the reference correction value eliminated positional deviation of the large dots arising during bi-directional printing. FIG. 26(C) shows vertical lines formed of large dots and lines formed of small dots, using the same adjustment condition as that used with respect to FIG. 26(B). In FIG. 26(C), deviation of the large dots has been eliminated but deviation of the small dots has not. In color images, the image quality of halftone regions is particularly critical, and positional deviation of small dots has a greater effect on the image quality than that of large dots. FIG. 26(D) shows vertical lines formed of large dots that have been subjected to deviation adjustment based on the reference correction value and the relative correction value ΔS for small dots. In FIG. 26(D), positional deviation of the small dots is reduced, while deviation of the large dots has increased slightly. Thus, as revealed by FIG. 26(D), deviation of small dots can be decreased, thereby improving the quality of halftone regions of color images, by using a reference correction value and a relative correction value.

When medium dots have a greater effect on image quality than small dots, positional deviation can be corrected by using a relative correction value ΔM for medium dots. When small dots and medium dots have roughly the same effect on image quality, positional deviation can be corrected using a value that is the average Δave of the relative correction values for small and medium dots, given by equation (7):

$$\begin{aligned}\Delta ave &= \{(\delta S-\delta L)+(\delta M-\delta L)\}/2 \\ &= \{(\delta S+\delta M)/2\}-\delta L\end{aligned} \tag{7}$$

As can be seen from equation (7), the average Δave of the relative correction values is the differential between an average of the deviation amounts δS, δM relating to the small and medium dots and the deviation amount δL relating to the reference dots.

As can be understood from this example, relative correction values do not have to relate to target dots of one specific size, but can be averaged for plural types of dots. The term "target dots" as used herein means one or plural types of dots subject to positional deviation correction. Target dots may include reference dots.

When printing in monochrome, positional deviation of large dots can have a larger effect on image quality. As such, in monochrome printing it is preferable to correct positional deviation using only the reference correction value for black dots, as shown in FIG. 26(B). Therefore, a configuration is desirable whereby, when the computer 88 communicates to the printer control circuit 40 (actually, the deviation correction section 210 of FIG. 17) that a printing operation is monochrome printing, just a reference correction value is used to correct positional deviation during bi-directional printing, while when the printing is color printing, positional deviation during bi-directional directional printing is corrected using both reference and relative correction values.

It may be possible, even in color printing, that positional deviation of the reference dots is particularly noticeable. In this case, it is preferable to correct the positional deviation using the reference correction value itself as an adjustment value. That is, the deviation correction section 210 can determine an adjustment value in accordance with either a first adjustment mode in which an adjustment value is determined from reference and relative correction values, or a second adjustment mode in which the reference correction value itself is employed as an adjustment value.

As described in the foregoing, in accordance with this third embodiment an adjustment value for correcting positional deviation of small and medium dots is determined by correcting a large dot reference correction value with a relative correction value prepared beforehand, thereby making it possible to improve the image quality of halftone regions. Since the test pattern for the user's adjustment is formed of large dots, the user can accurately determine an adjustment value to correct the positional deviation.

F. Modifications:

The present invention is in no way limited to the details of the embodiments and examples described in the foregoing but may be changed and modified in various ways to the extent that such changes and modifications do not depart from the essential scope thereof. For example, the modifications described below are possible.

F1. Modification 1:

With respect to a printer in which the carriage can be moved at different main scanning velocities (speeds), it is preferable that a relative correction value relating to a row of nozzles should be set for each of such main scanning velocities. As can be understood from the explanation made with reference to FIG. 9, changing the main scanning velocity Vs also changes the degree of relative positional deviation between the rows of nozzles. As such, setting a relative correction value for each main scanning velocity makes it possible to achieve a further decrease in positional deviation during bi-directional printing.

F2. Modification 2:

With respect to a multilevel printer which is capable of printing dots of the same color in different sizes, it is preferable to set a relative correction value for each dot size. Setting a relative correction value for each dot size makes it possible to achieve a further decrease in positional deviation during bi-directional printing. Sometimes a multilevel printer is only able to form dots of the same size in one main scanning pass using one row of nozzles. When this is the case, a dot size is selected for each main scanning pass, so with respect also to the relative correction value used to correct the positional deviation, for each main scanning pass a suitable value is selected in accordance with the dot size concerned.

The printing operations each produces dots of different size may be thought to be different printing modes that emit ink at mutually different velocities. The Modification 2 therefore would mean setting relative correction values with respect to each of the plural printing modes in which dots are formed using ink emitted at different velocities.

F3. Modification 3:

In the case of the first and second embodiments it is preferable to set relative correction values independently for each row of nozzles other than the reference row of nozzles. This makes it possible to further decrease positional deviation. Relative correction values can also be separately set for each group of nozzle rows that emit ink of the same color. For example, if the head is provided with two rows of nozzles that emit a specific ink, the same relative correction value can be applied to the nozzles of both rows for the specific ink.

F4. Modification 4:

In the first to third embodiments the row of black ink nozzles is selected as the reference row of nozzles when determining the reference and relative correction values. However, it is also possible to select a different row of nozzles as the reference. However, selecting a low density color ink such as light cyan or light magenta makes it harder for a user to read the test pattern used during determination of a reference correction value. Therefore, it is preferable to select as the reference a row of nozzles used to emit a relatively high density ink such as black, dark cyan, and dark magenta.

F5. Modification 5:

In the first to third embodiments positional deviation is corrected by adjusting the position (or timing) at which dots are printed. However, positional deviation may be corrected by other methods, for example by delaying the drive signals to the actuator chips or by adjusting the frequency of the drive signals.

F6. Modification 6:

In the third embodiment, it is assumed that a single nozzle can print any one of three dots of different sizes at a single pixel position. Normally the concept of the third embodiment can be applied to a printer that can use one nozzle to print any one of N sizes of dots (where N is an integer of 2 or more) at each pixel position. In this case, as the dots targeted for adjustment to correct positional deviation, there can be selected at least one type of dots among the N types of dots. The at least one type of dots preferably includes relatively small dots other than the largest dots. The adjustment value used to correct deviation of the target dots can be applied in common to the N types of dots.

The smallest among the N types of dots can be selected as the target dots, and so can the dots of medium size. Selecting these as the target dots would improve the quality of halftone image regions.

"[D]ots of a medium size among the N types of dots" refers to {(N+1)/2}-th largest dots when N is an odd number, and to {N/2}-th or {N/2+1}-th largent dots when N is an even number. Instead, as medium sized dots, there may be employed the dots that are used in the greatest numbers when the image signal indicates a density level of 50%.

F7. Modification 7:

In each of the foregoing embodiments positional deviation is corrected by adjusting the positioning (or timing) of dots printed during a reverse pass. However, positional deviation may be corrected by adjusting the positioning of dots printed during a forward pass, or by adjusting the positioning of dots printed during both forward and reverse passes. Thus, all that matters is that the positions at which dots are printed be adjusted during at least one selected from a forward pass and a reverse pass.

F8. Modification 8:

The above embodiments were each described with respect to an inkjet printer. However, the present invention is not limited thereto and may be applied to any of various printing apparatuses that print using a print head. Similarly, the present invention is not limited to an apparatus or method for emitting ink droplets, but can also be applied to apparatuses and methods used to print dots by other means.

F9. Modification 9:

While the configurations of the above embodiments have been implemented in terms of hardware, the configurations may be partially replaced by software. Conversely, software-based configurations may be partially replaced by hardware. For example, some of the functions of the head drive circuit 52 shown in FIG. 12 may be implemented in software.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A bi-directional printing apparatus that bi-directionally prints images on a print medium during forward and reverse main scanning passes in accordance with print image signals, the printing apparatus comprising:

a print head configured to print dots at each pixel position on the print medium;

a main scanning drive mechanism configured to effect bi-directional main scanning by moving at least one of the print medium and the print head;

a sub-scanning drive mechanism configured to effect sub-scanning by moving at least one of the print medium and the print head;

a head driver configured to supply drive signals to the print head to effect printing on the print medium; and a controller configured to control bi-directional printing, the controller including a printing position adjuster that uses a bi-directional printing position adjustment value to reduce printing positional deviation arising between the forward and reverse main scanning passes, wherein the printing position adjuster includes:

a first memory configured to store a reference correction value for correcting the printing positional deviation arising between the forward and reverse main scanning passes with respect to specific reference dots formed by the print head, a second memory configured to store a relative position correction value prepared beforehand for correcting the reference correction value with respect to a bi-directional printing position deviation, and an adjustment value determination section configured to determine the bi-directional printing position adjustment value, the adjustment value determination section having at least a first adjustment mode in which the bi-directional printing position adjustment value is determined by correcting the reference correction value with the relative position correction value.

2. A bi-directional printing apparatus according to claim 1, wherein the print head prints N types (where N is an integer of 2 or more) of dots that are different at least in size;

the reference dots are one type of dots selected from among the N types of dots; and the bi-directional printing position adjustment value is applied in common to the N types of dots in the first adjustment mode.

3. A bi-directional printing apparatus according to claim 2, wherein the reference dots are largest of the N types of dots.

4. A bi-directional printing apparatus according to claim 2, wherein the relative position correction value substantially represents a difference between an amount of positional deviation relating to target dots and an amount of positional deviation relating to the reference dots, the target dots including at least one type of dots among the N types of dots, the at least one type of dots including dots smaller than the reference dots.

5. A bi-directional printing apparatus according to claim 4, wherein the target dots are smallest of the N types of dots.

6. A bi-directional printing apparatus according to claim 4, wherein the target dots include plural types of dots of different sizes, and an average of positional deviation amounts of the plural types of dots is used as the amount of positional deviation for the target dots.

7. A bi-directional printing apparatus according to claim 4, wherein the reference dots are formed of black ink and the target dots are formed of chromatic color ink.

8. A bi-directional printing apparatus according to claim 1, wherein the adjustment value determination section has a second adjustment mode in which the reference correction value is used as the bi-directional printing position adjustment value, and the adjustment value determination section effects correction of the printing positional deviation in accordance with the first adjustment mode during color printing and effects correction of the printing positional deviation in accordance with the second adjustment mode during monochrome printing.

9. A bi-directional printing apparatus according to claim 1, wherein the reference correction value is determined according to correction information indicative of a preferred correction state that is selected from among test patterns of positional deviation printed using the reference dots.

10. A bi-directional printing apparatus according to claim 1, wherein the bi-directional printing apparatus performs main scanning at a plurality of main scanning velocities, and the second memory stores the relative position correction values that are applied independently to the plurality of main scanning velocities.

11. A bi-directional printing apparatus according to claim 1, wherein the bi-directional printing apparatus emits ink in a plurality of dot emission modes of mutually different ink emission velocities, and the second memory stores the relative position correction values that are applied independently to the plurality of dot emission modes.

12. A bi-directional printing apparatus according to claim 1, wherein the second memory is a non-volatile memory provided within the bi-directional printing apparatus.

13. A bi-directional printing apparatus according to claim 1, wherein the second memory is attached to the print head so that the print head with the second memory is detachably attached to the bi-directional printing apparatus.

14. A bi-directional printing method with a printing apparatus having a print head for bi-directionally printing images on a print medium during forward and reverse main scanning passes in accordance with print image signals, the method comprising:

setting a reference correction value for correcting printing positional deviation arising between the forward and reverse main scanning passes with respect to specific reference dots formed by the print head;

determining a bi-directional printing position adjustment value to reduce printing positional deviation arising between the forward and reverse main scanning passes; and adjusting the printing positional deviation between the forward and reverse main scanning passes using the bi-directional printing position adjustment value, wherein determining the bi-directional printing position adjustment value includes at least a first adjustment mode that corrects the reference correction value with a relative position correction value prepared beforehand for correcting the reference correction value with respect to a bi-directional printing position deviation.

15. A bi-directional printing method according to claim 14, wherein the print head has a plurality of nozzle rows;

the reference correction value is a correction value for correcting the printing positional deviation arising between the forward and reverse main scanning passes with respect to a reference row of nozzles; and the relative position correction value is a correction value for correcting relative printing positional deviation of another row against the reference row.

16. A bi-directional printing method according to claim 15, wherein the reference row is a row of nozzles for emitting black ink and the another row includes a row of nozzles for emitting chromatic color ink.

17. A bi-directional printing method according to claim 15, wherein the relative position correction value is applied in common to rows of nozzles other than the reference row.

18. A bi-directional printing method according to claim 15, wherein the relative position correction value is prepared for each of the rows of nozzles other than the reference row so that relative position correction values are applied independently to respective rows of nozzles other than the reference row.

19. A bi-directional printing method according to claim 15, wherein the relative position correction value is prepared for each group of nozzles for emitting respective inks so that the relative position correction values are applied independently to respective groups of nozzles for emitting respective inks.

20. A bi-directional printing method according to claim 14, wherein the print head prints N types (where N is an integer of 2 or more) of dots that are different at least in size;

the reference dots are one type of dots selected from among the N types of dots; and the bi-directional printing position adjustment value is applied in common to the N types of dots in the first adjustment mode.

21. A bi-directional printing method according to claim 20, wherein the reference dots are largest of the N types of dots.

22. A bi-directional printing method according to claim 20, wherein the relative position correction value substantially represents a difference between an amount of positional deviation relating to target dots and an amount of positional deviation relating to the reference dots, the target dots including at least one type of dots among the N types of dots, the at least one type of dots including dots smaller than the reference dots.

23. A bi-directional printing method according to claim 22, wherein the target dots are smallest of the N types of dots.

24. A bi-directional printing method according to claim 22, wherein the target dots include plural types of dots of different sizes, and an average of positional deviation amounts of the plural types of dots is used as the amount of positional deviation for the target dots.

25. A bi-directional printing method according to claim 22, wherein the reference dots are formed of black ink and the target dots are formed of chromatic color ink.

26. A bi-directional printing method according to claim 14, wherein determining the bi-directional printing position adjustment value includes at least a second adjustment mode in which the reference correction value is used as the bi-directional printing position adjustment value; wherein the adjustment of the printing positional deviation is executed in accordance with the first adjustment mode during color printing and in accordance with the second adjustment mode during monochrome printing.

27. A bi-directional printing method according to claim 14, wherein the reference correction value is determined according to correction information indicative of a preferred correction state that is selected from among test patterns of positional deviation printed using the reference dots.

28. A bi-directional printing method according to claim 14, wherein the printing apparatus performs main scanning at a plurality of main scanning velocities, and the relative position correction value is prepared for each main scanning velocity so that the relative position correction values are applied independently to the plurality of main scanning velocities.

29. A bi-directional printing method according to claim 14, wherein the printing apparatus emits ink in a plurality of dot emission modes of mutually different ink emission velocities, and the relative position correction value is prepared for each dot emission mode so that the relative position correction values are applied independently to the plurality of dot emission modes.

30. A computer program product storing a computer program for causing a computer to bi-directionally print images on a print medium during forward and reverse main scanning passes, the computer including a printing apparatus having a print head for printing plural types of dots on the print medium, the computer program product comprising:

a computer readable medium; and a computer program stored on the computer readable medium, wherein the computer program causes the computer to determine a bi-directional printing position adjustment value to reduce printing positional deviation arising between the forward and reverse main scanning passes in accordance with at least a first adjustment mode in which the bi-directional printing position deviation adjustment value is determined by correcting a reference correction value for specific reference dots with a relative position correction value prepared beforehand for correcting the reference correction value with respect to a bi-directional printing position deviation.

* * * * *